US005985156A

United States Patent [19]

Henkin et al.

[11] Patent Number: 5,985,156

[45] Date of Patent: Nov. 16, 1999

[54] AUTOMATIC SWIMMING POOL CLEANING SYSTEM

[76] Inventors: Melvyn L. Henkin, 1001 Sharon La.; Jordan M. Laby, 1389 Beachmont, both of Ventura, Calif. 93001

[21] Appl. No.: 08/998,170

[22] Filed: Dec. 25, 1997

Related U.S. Application Data

[63] Continuation of application No. PCT/US96/11238, Jun. 26, 1996.

[51] Int. Cl.[6] ..... B01D 17/12

[52] U.S. Cl. ..... 210/744; 210/97; 210/143; 210/169; 210/242.1; 210/776; 15/1.7; 134/167 R

[58] Field of Search ..... 134/167 R, 168 R; 15/1.7; 210/97, 109, 169, 241, 242.1, 318, 416.2, 739, 776, 138, 143, 744

[56] References Cited

U.S. PATENT DOCUMENTS

| | | | |
|---|---|---|---|
| 3,384,914 | 5/1968 | Wilhelman . | |
| 3,392,738 | 7/1968 | Pansini | 134/167 R |
| 3,675,261 | 7/1972 | Burgess . | |
| 3,805,815 | 4/1974 | Goodin . | |
| 3,921,654 | 11/1975 | Pansini | 134/167 R |
| 4,040,864 | 8/1977 | Steeves . | |
| 4,129,904 | 12/1978 | Pansini . | |
| 4,154,680 | 5/1979 | Sommer . | |
| 4,281,995 | 8/1981 | Pansini . | |
| 4,463,525 | 8/1984 | Sheber . | |
| 4,569,361 | 2/1986 | Frentzel . | |
| 4,589,986 | 5/1986 | Greskovics . | |
| 4,592,378 | 6/1986 | Frentzel . | |
| 4,652,366 | 3/1987 | Brooks . | |
| 4,686,728 | 8/1987 | Rawlings . | |
| 4,749,478 | 6/1988 | Brooks . | |
| 4,778,599 | 10/1988 | Brooks . | |
| 4,784,171 | 11/1988 | Campbell . | |
| 4,835,809 | 6/1989 | Roumgnar . | |
| 4,837,886 | 6/1989 | Rawlins . | |
| 4,849,024 | 7/1989 | Supra . | |
| 4,994,178 | 2/1991 | Brooks . | |
| 5,029,600 | 7/1991 | McCullough . | |
| 5,077,853 | 1/1992 | Campbell . | |
| 5,128,031 | 7/1992 | Midkiff . | |
| 5,133,854 | 7/1992 | Horwath . | |
| 5,350,508 | 9/1994 | Van Der Watt . | |
| 5,435,031 | 7/1995 | Minami et al. | 15/1.7 |
| 5,788,850 | 8/1998 | Tuomey | 210/169 |

FOREIGN PATENT DOCUMENTS

| | | |
|---|---|---|
| 590252 | 1/1960 | Canada . |
| 54-9457 | 1/1979 | Japan . |
| 54-15365 | 2/1979 | Japan . |
| 54-56251 | 5/1979 | Japan . |
| 71/0577 | 1/1971 | South Africa . |

*Primary Examiner*—Joseph W. Drodge
*Attorney, Agent, or Firm*—Freilich, Hornbaker & Rosen

[57] ABSTRACT

A pool cleaning method and apparatus for selectively positioning a unitary body either close to the water surface or close to the bottom wall surface. In an exemplary embodiment, the body rests at the bottom and the subsystem lifts the device to the water surface for operation in a water surface cleaning mode to collect floating debris. A propulsion subsystem is preferably incorporated to move the body along the wall surface and/or water surface.

22 Claims, 27 Drawing Sheets

14
14A
LEVEL MODE CONTROLLER
14B
USER INPUT
14C
EVENT SENSOR
14D
LEVEL CONTROL
ASCEND
DESCEND
WALL SURFACE
WATER SURFACE
14E
CLEANING CONTROL
SKIM, SWEEP
VACUUM, SWEEP
16
16A
PROPULSION STATE CONTROLLER
16B
EVENT SENSOR
16C
USER INPUT
NORMAL
BACKUP
16D
DIRECTION CONTROL
FORWARD
REARWARD
16E
STEERING

AUTOMATIC SWIMMING POOL CLEANING SYSTEM

RELATED APPLICATIONS

This application is a continuation of International Application PCT/US96/11238 filed Jun. 26, 1996. This application also relates to U.S. application Ser. No. 08/998, 528, filed Dec. 26, 1997, entitled POSITIVE PRESSURE AUTOMATIC SWIMMING POOL CLEANING SYSTEM and copending U.S. application Ser. No. 08/998, 529, filed Dec. 26, 1997, entitled WATER SUCTION POWERED AUTOMATIC SWIMMING POOL CLEANING SYSTEM filed by the same inventors, whose respective disclosures are incorporated herein by reference.

FIELD OF THE INVENTION

The present invention relates to a method and apparatus suitable for cleaning a swimming pool.

BACKGROUND OF THE INVENTION

The prior art is replete with different types of automatic swimming pool cleaners. They include water surface cleaning devices which typically float at the water surface and can be moved across the water surface for cleaning, as by skimming. The prior art also shows pool wall surface cleaning devices which can rest at the pool bottom and can be moved along the wall (which term should be understood to include bottom and side portions) for wall cleaning, as by vacuuming and/or sweeping. Some prior art assemblies include both water surface cleaning and wall surface cleaning components tethered together.

SUMMARY OF THE INVENTION

The present invention is directed to a method and apparatus useful for cleaning a water pool contained in an open vessel defined by a wall having bottom and side portions.

Apparatus in accordance with the invention includes (1) a unitary structure or body capable of being immersed in a water pool and (2) a level control subsystem for selectively moving the body to a position either proximate to the surface of the water pool for water surface cleaning or proximate to the interior surface of the vessel wall for wall surface cleaning.

Embodiments of the invention can use either a heavier-than-water body or a lighter-than-water body. When a heavier-than-water body is used, the body in its quiescent or rest state typically sinks to a position proximate to the bottom portion of the vessel wall. In an active state, the level control subsystem produces a vertical force component for lifting the body to proximate to the water surface for operation in a water surface cleaning mode.

When a lighter-than-water body is used, the body in its quiescent state floats at a position proximate to the water surface. In an active state, the level control subsystem produces a vertical force component for causing the body to descend to proximate the wall bottom portion for operation in a wall surface cleaning mode.

When in the water surface cleaning mode, debris is collected from the water surface. When in the wall surface cleaning mode, debris is collected from the wall surface.

Embodiments of the invention preferably also include a propulsion subsystem for producing a nominally horizontal force component for moving the body along (1) a path adjacent to the water surface when the body is in the water surface cleaning mode and (2) a path adjacent to the wall surface when the body is in the wall surface cleaning mode.

Preferred embodiments of the invention are configured to be hydraulically powered, either from the pressure or suction side of an external hydraulic pump. Proximal and distal ends of a flexible supply hose are respectively coupled to the pump and body for producing a water supply flow through the body for powering the aforementioned subsystems. The hose is preferably configured so that it typically primarily lies close to the vessel interior wall surface with the hose distal end being dragged along by the movement of the body.

More particularly, in the exemplary preferred embodiments, the water supply flow is directed by one or more control elements (e.g., valve) to, directly or indirectly, create water flows for producing the vertical and horizontal force components respectively needed for level control and propulsion. A preferred propulsion subsystem can define either a normal state in which a force component is produced for moving the body in a forward direction and a backup state for producing a force component for moving the body in a rearward direction. Water surface and wall surface cleaning typically occurs during the normal propulsion mode. The backup propulsion state is preferably initiated to enable the body to free itself from obstructions.

The body preferably carries a water permeable debris container. In the water surface cleaning mode, a flow of surface water is created through the debris container which removes floating debris from the water surface. In the wall surface cleaning mode, a water flow from adjacent to the wall surface is created for vacuuming debris from the wall surface.

The operating modes of the level control subsystem are preferably switched automatically in response to the occurrence of an event, such as the (1) expiration of a time interval, (2) the cycling of the external pump, or (3) a state change of the propulsion subsystem. The operating states of the propulsion subsystem are preferably switched automatically in response to the occurrence of an event such as the expiration of a time interval and/or the interruption of body motion.

DESCRIPTION OF PREFERRED EMBODIMENTS

Figure 1A:
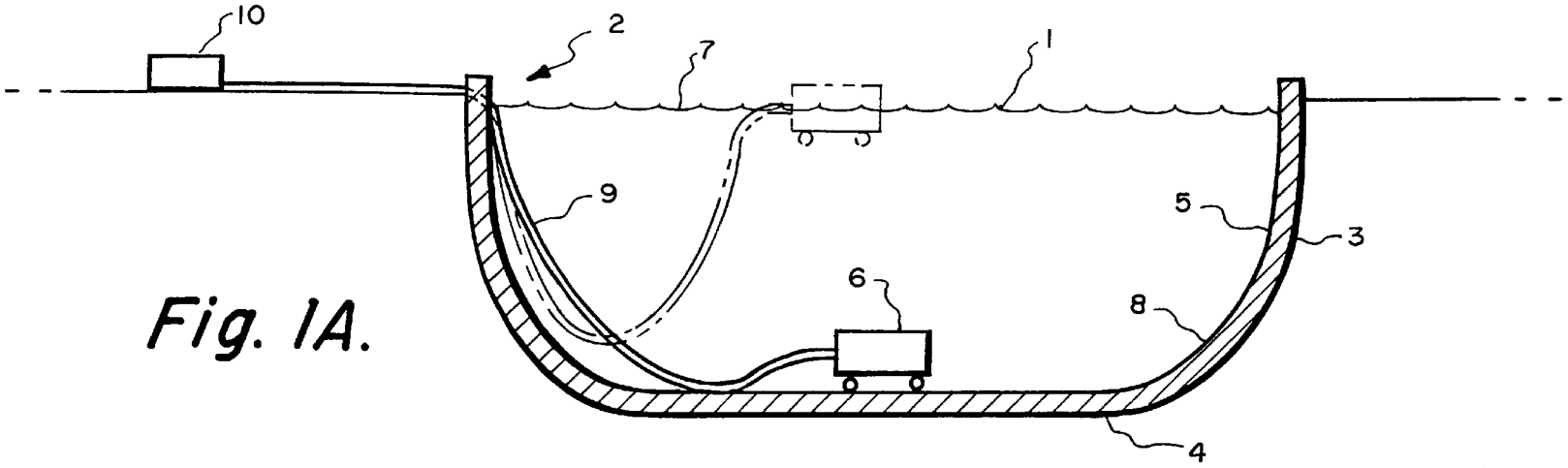
FIGS. 1A and 1B respectively schematically depict heavier-than-water and lighter-than-water embodiments of the invention shown in water pools contained in open vessels.
Figure 1B:
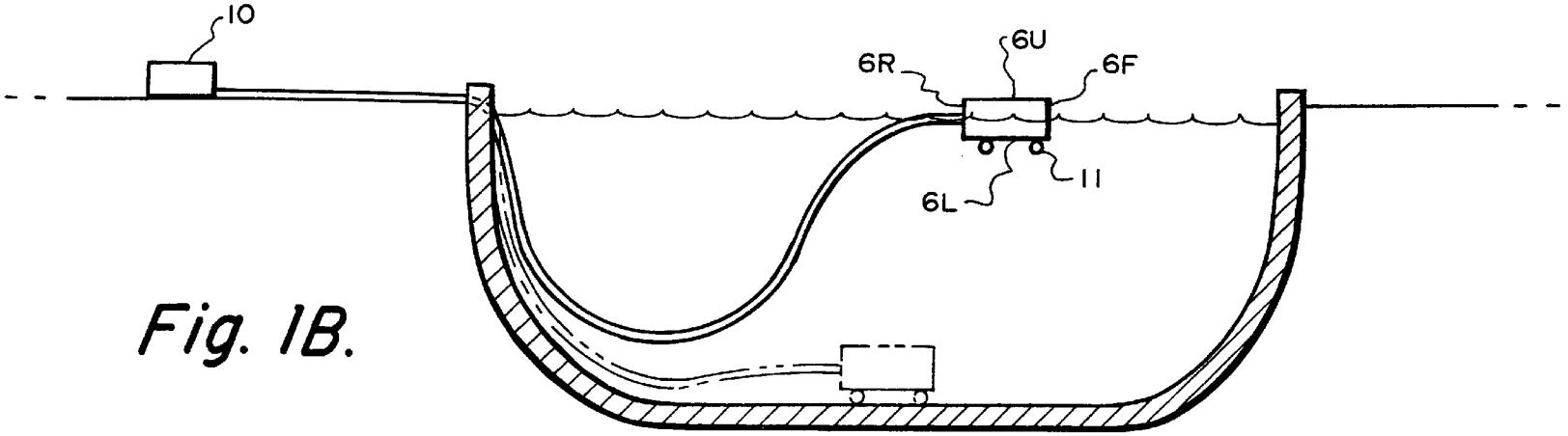

With reference to Figures 1A and 1B, the present invention is directed to a method and apparatus for cleaning a water pool 1 contained in an open vessel 2 defined by a containment wall 3 having bottom 4 and side 5 portions. Embodiments of the invention utilize a unitary structure or body 6 capable of being immersed in the water pool 1, for selective operation proximate to the water surface 7 (water surface cleaning mode) or proximate to the interior wall surface 8 (wall surface cleaning mode).

The unitary body 6 preferably has a hydrodynamically contoured exterior surface for efficient travel through the water. Although bodies 6 in accordance with the invention can be very differently shaped, it is intended that they be relatively compact in size fitting within a two foot cube envelope. FIG. 1A depicts a heavier-than-water body 6 which in its quiescent or rest state typically sinks to a position (shown in solid line) proximate to the bottom portion 4 of the vessel wall 3. In an active state, the body 6 is lifted to a position (shown in dash line) proximate to the surface 7 of water pool 1. Alternatively, FIG. 1B depicts a lighter-than-water body 6 which in its quiescent or rest state rises to proximate to the surface 7 of water pool 1. In an active state, the body 6 is caused to descend to the bottom 4 portion of wall 3. The active state in either FIG. 1A or FIG. 1B is typically produced in accordance with preferred embodiments of the invention by a water flow through flexible hose 9 to or from hydraulic pump 10.

The body 6 is essentially comprised of upper and lower portions, 6U and 6L respectively, spaced in a nominally vertical direction, and front and rear portions, 6F and 6R respectively, spaced in a nominally horizontal direction. A traction means such as wheels 11 are typically mounted adjacent the body lower portion 6L for engaging the wall surface 8.

Embodiments of the invention are based, in part, on a recognition of the following considerations:

1. Effective water surface cleaning (skimming) reduces the overall task of swimming pool cleaning since most debris in the water and on the vessel wall surface previously floated on the water surface.

2. A water surface cleaner capable of floating or otherwise traveling to the same place that the debris floats can capture debris more effectively than a fixed position built-in skimmer.

3. A water surface cleaner can operate by using a weir, a water entrainment device, or by scooping up debris as it moves across the water surface. The debris can be collected in a water permeable container.

4. A single unitary structure or body can be used to selectively operate proximate to the water surface in a water surface cleaning mode and proximate to the wall surface in a wall surface cleaning mode. A common debris collection container can be used in both modes.

5. The level of the body in the water pool, i.e., proximate to the water surface or proximate to the wall surface, can be controlled by a level control subsystem capable of selectively defining either a water surface mode or a wall surface mode. The mode defined by the subsystem can be selected via a user control, e.g., a manual switch or valve, or via an event sensor responsive to an event such as the expiration of a time interval.

6. The movement of the body in the water pool can be controlled by a propulsion subsystem, preferably operable to selectively propel the body in either a forward or rearward direction. The direction is preferably selected via an event sensor which responds to an event such as the expiration of a time interval or an interruption of the body's motion.

7. A cleaning subsystem can be operated in either a water surface cleaning mode (e.g., skimming) or a wall surface cleaning mode (e.g., vacuuming or sweeping).

8. The subsystems can be powered from a common source or from different sources which can include hydraulic (either positive or negative pressure), pneumatic, and electrical.

Four exemplary embodiments of the invention will be described hereinafter. All of these embodiments will be assumed to utilize a heavier-than-water body which in a quiescent state rests proximate to the wall bottom and in an active state rises to proximate to the water surface. The first three embodiments are configured to be driven from the discharge or positive pressure side of a motor driven hydraulic pump. The fourth embodiment (FIGS. 21–27) is configured to be driven from the intake or negative pressure (suction) side of such a pump.

Figure 2:
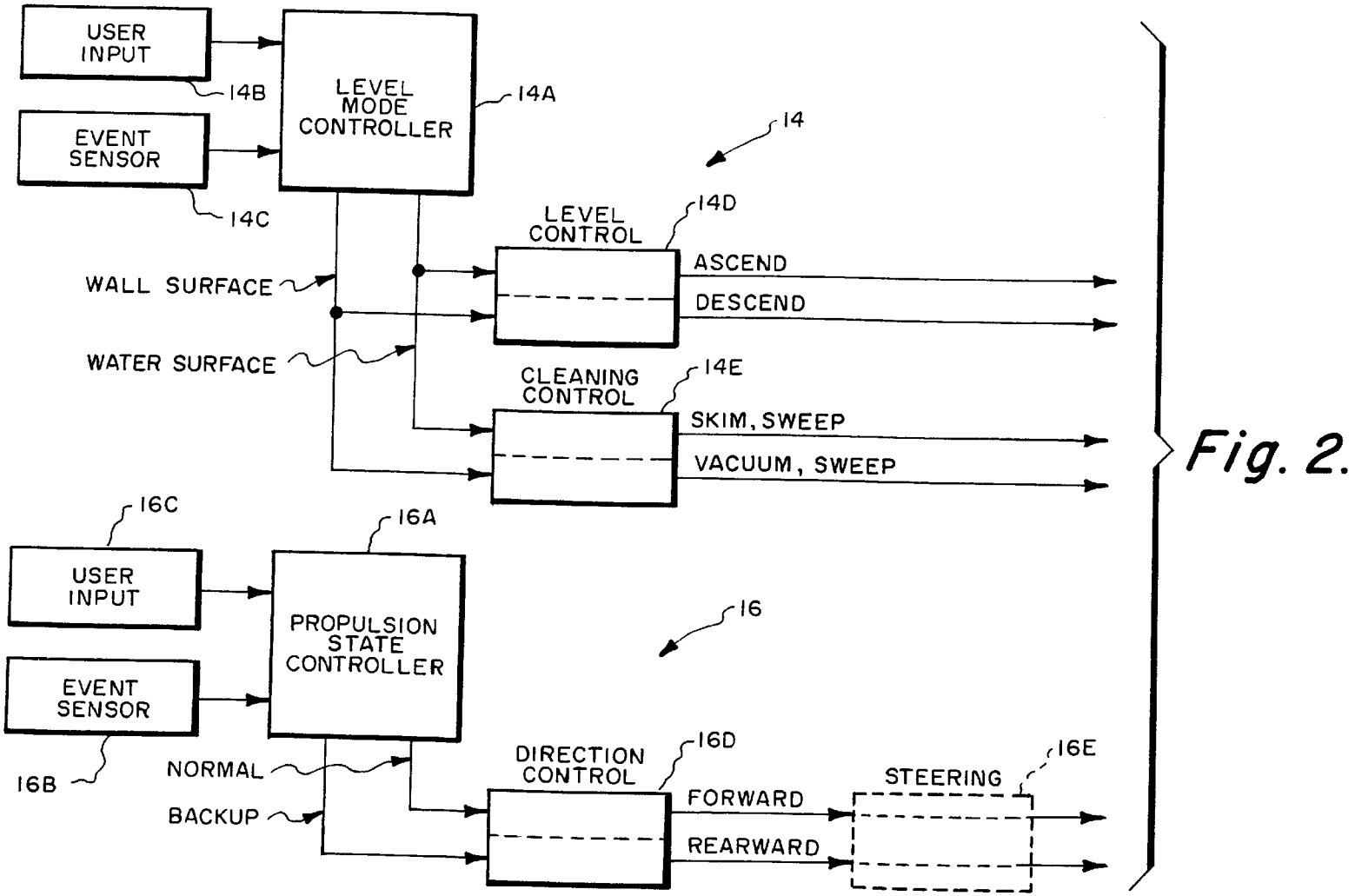
FIG. 2 is a functional block diagram generally depicting level control and propulsion control subsystems utilized in preferred embodiments of the invention.
Figure 3:
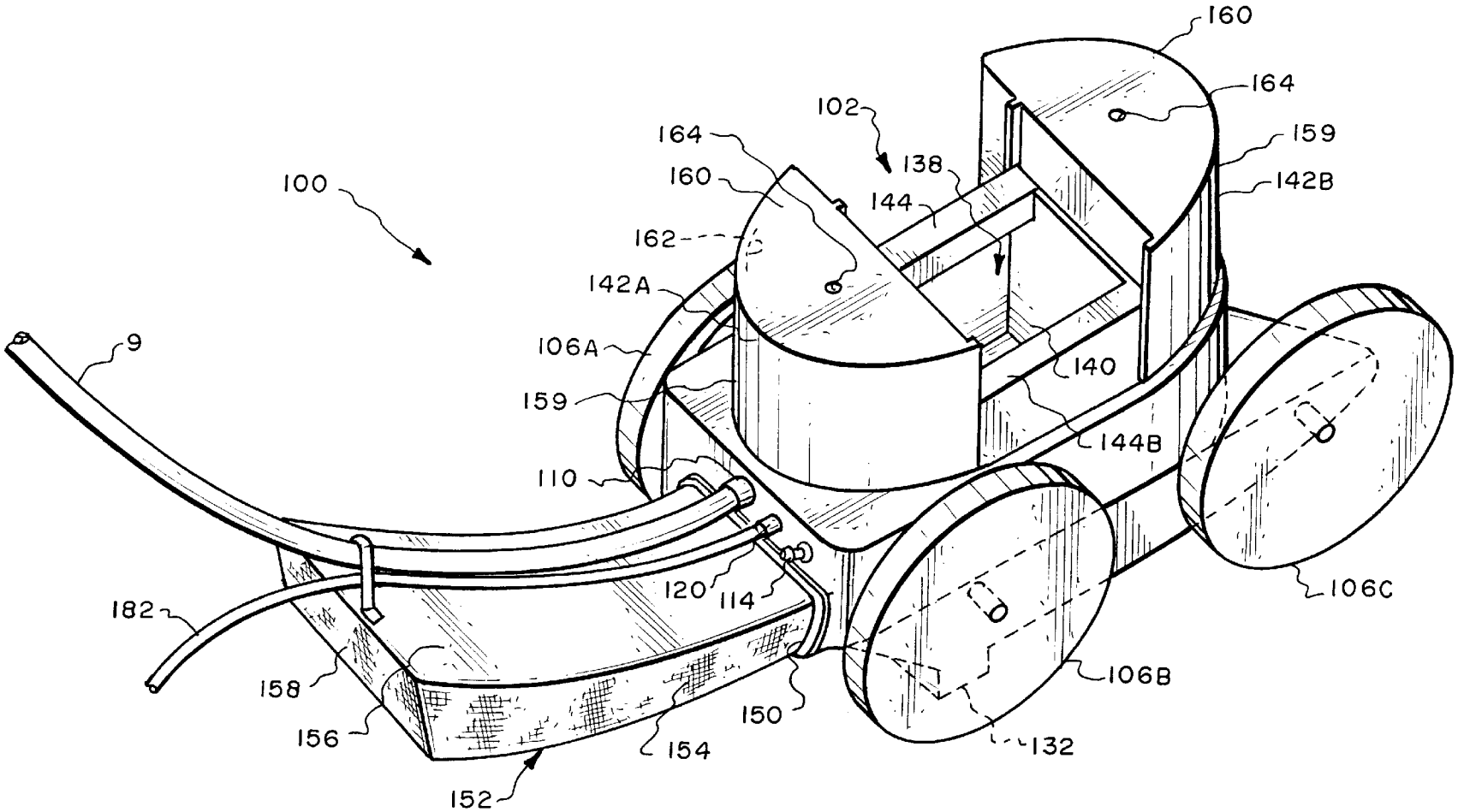
FIGS. 3–7 illustrate a first structural embodiment of the invention capable of selectively operating in (1) a water surface cleaning mode and (2) a wall cleaning mode.
Figure 4:
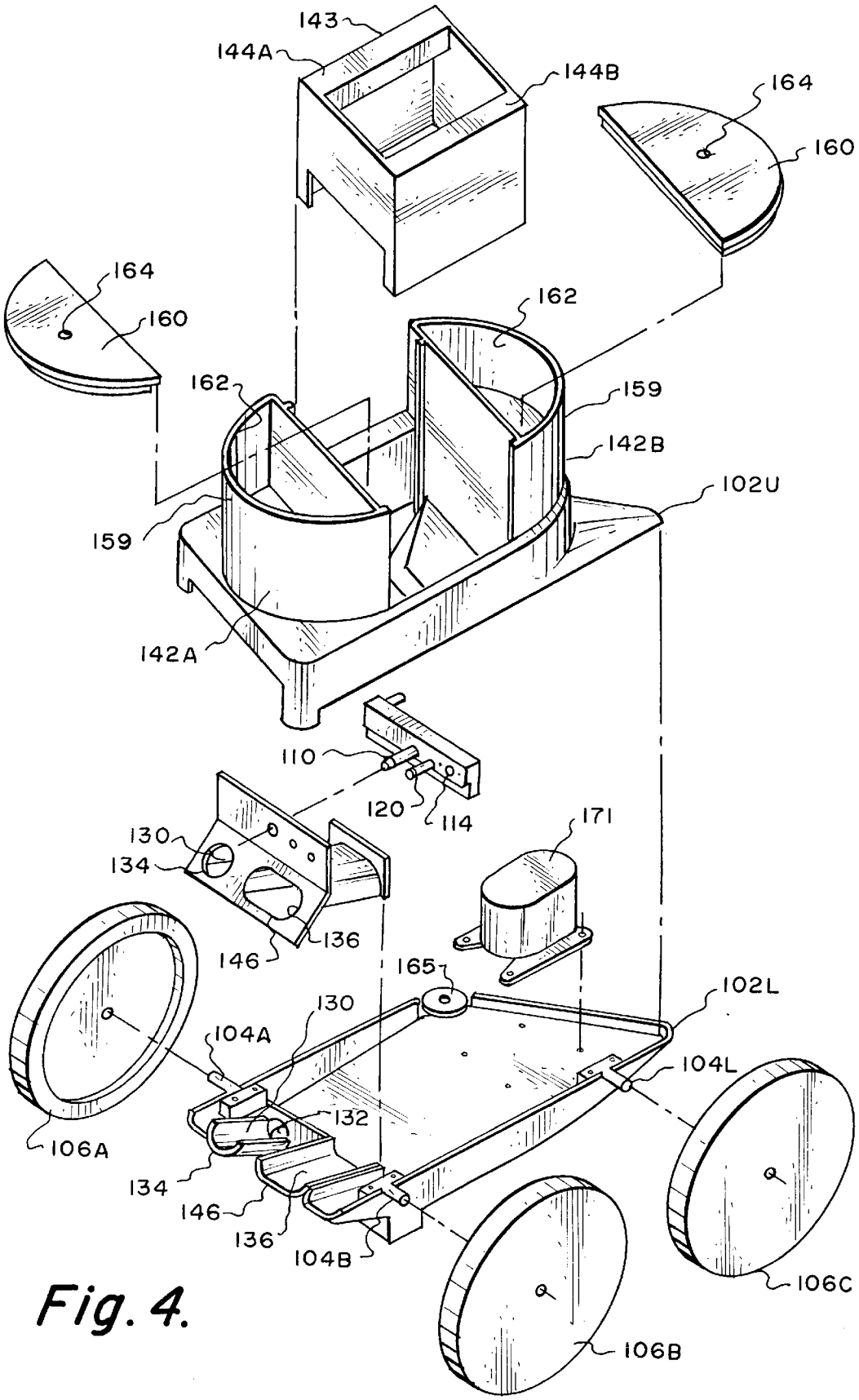
Figure 5:
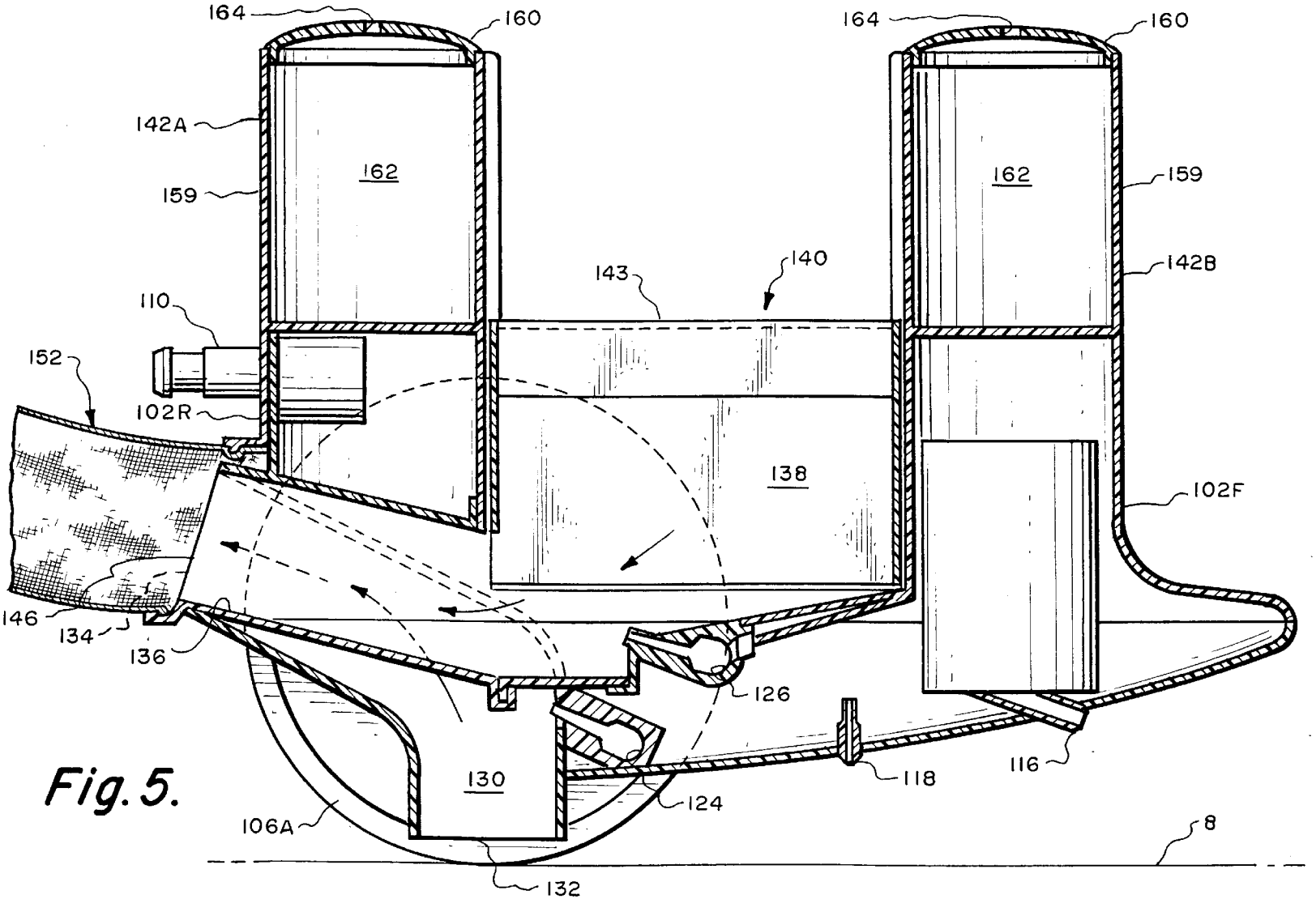
Figure 6:
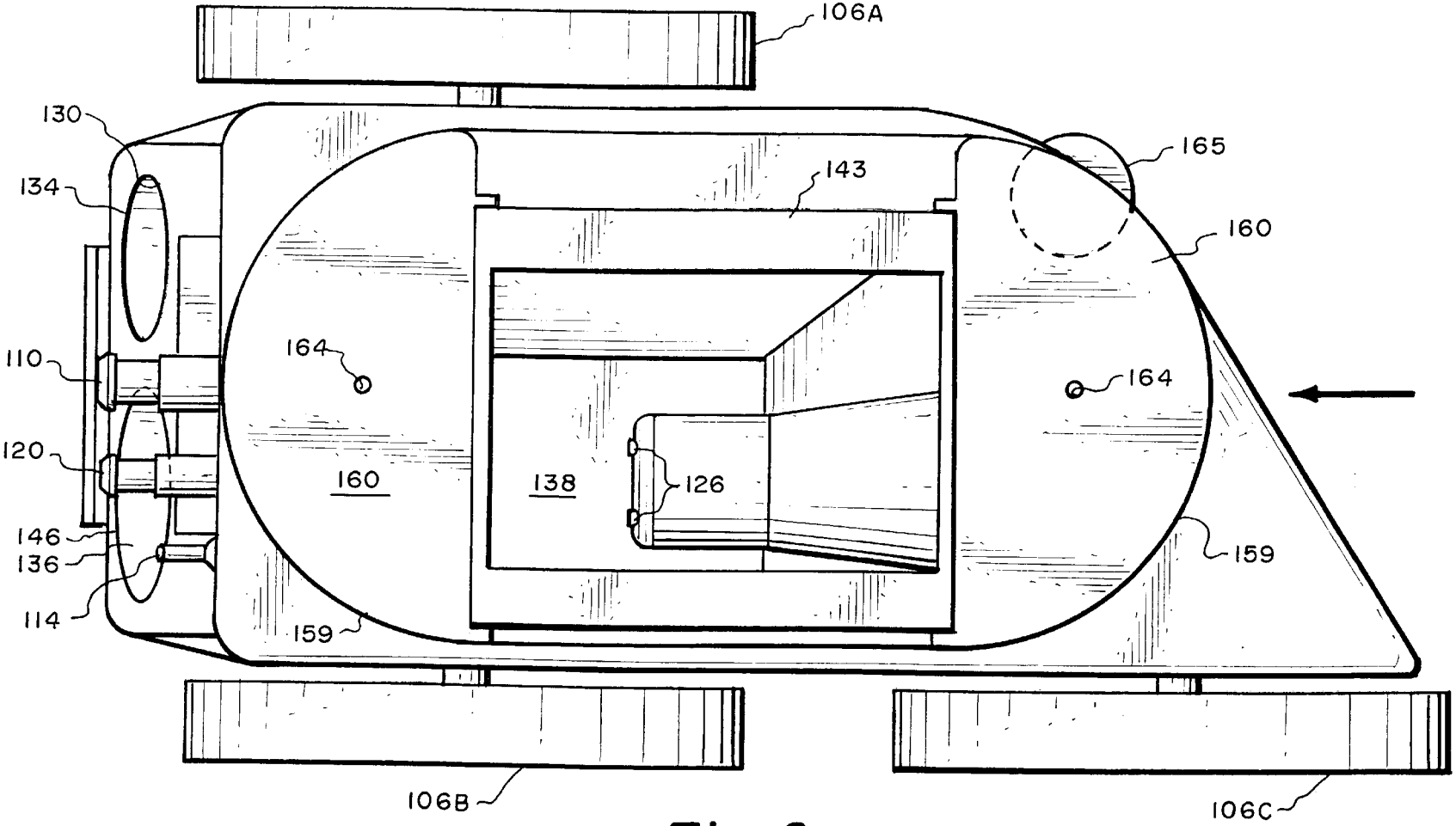
Figure 7:
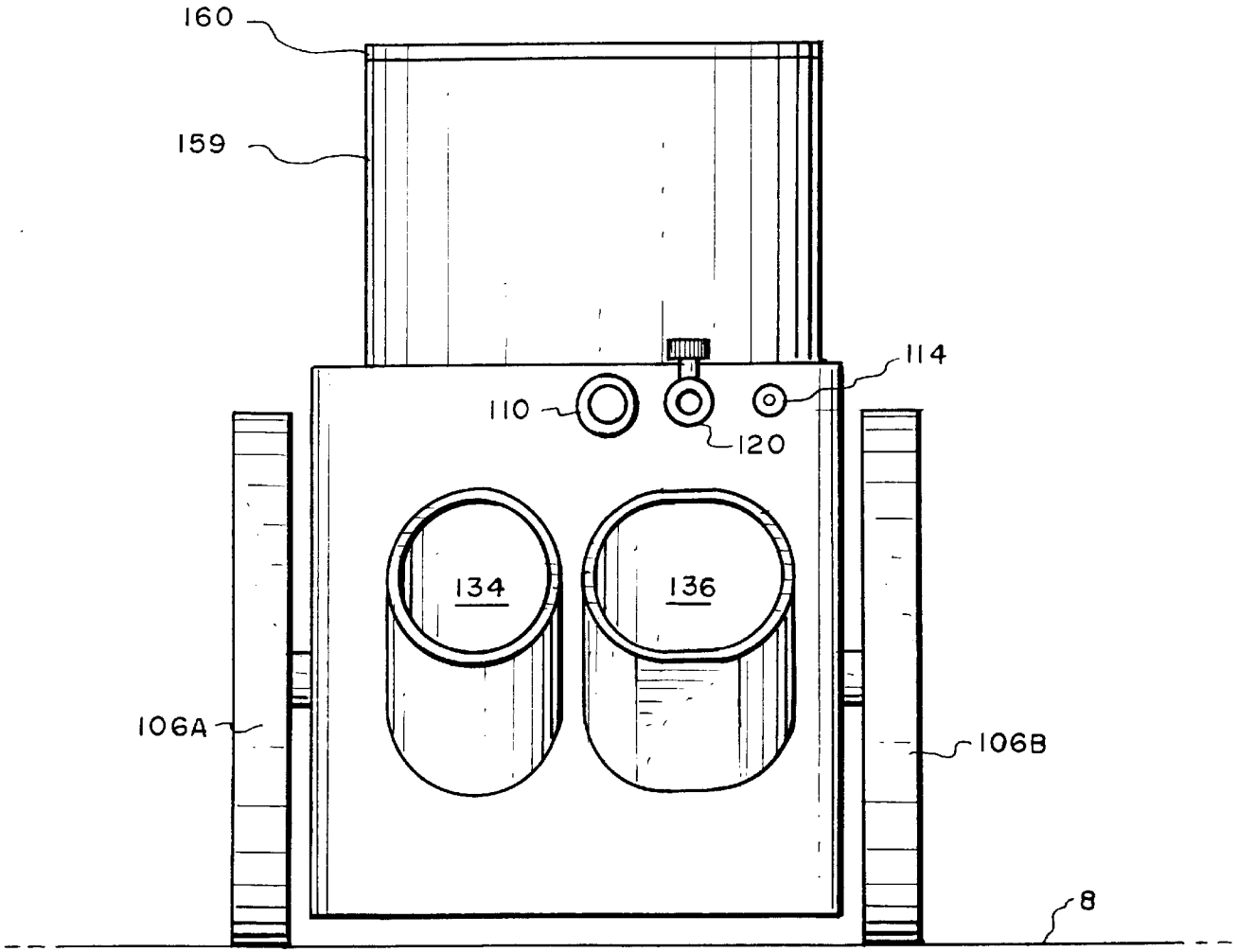

Since the several embodiments have structural, functional, and operational features in common, several general comments will initially be presented with reference to FIG. 2, followed by a detailed discussion of each embodiment and its related Figures.

FIG. 2 comprises a schematic diagram generally representing the primary functional aspects of preferred systems in accordance with the invention. The system of FIG. 2 is shown as primarily including a level control subsystem 14 and a propulsion control subsystem 16. The level control subsystem 14 is comprised of a level mode controller 14A capable of selectively defining either a first mode (water surface level) or a second mode (wall surface level). The mode defined by controller 14A is determined by a user input 14B such as a manual switch or by an event sensor 14C in response to an event such as the expiration of a time interval or the cycling of pump 10. Thus, for example, in typical operation, the body 6 can be operated in the water surface mode for a one hour interval and then switched to the wall surface mode for a two hour interval. Alternatively, if the user desires that the body continue to operate in a particular mode, that mode can be set via user input 14B which overrides the mode toggling normally produced by event sensor 14C. The mode defined by controller 14A controls level control element 14D, e.g., a valve, which causes the body 6 to either ascend to proximate to the water surface or descend to proximate to the wall bottom.

Although embodiments of the invention can be implemented with the body's rest state being either proximate to the water surface or the wall bottom, the former implementation is presently preferred because when at rest, the body will be unobtrusively out of the way of swimmers.

Resting at the water surface can be achieved with sufficient buoyancy built into the body 6 so that it floats at rest, with weight low and buoyancy high so it is stable (right side up) at both the water surface and at the wall bottom. In order to clean the side and bottom portions of the wall surface, a sufficient hold down force must be produced to keep the traction means 11 in adequate contact with the wall surface.

Resting on the wall bottom requires that the body 6 sink when it is not powered. It must have its weight low and buoyancy high so it is stable on the water surface and beneath it. The body 6 can be moved from the wall bottom to the water surface by producing a vertical force component, e.g., by an appropriately directed water flow, as will be discussed hereinafter, to push the body to the water surface.

To provide ease of installation and use, and to provide tolerance for the magnitude of the lifting force and the weight of the body when carrying different amounts of collected debris, and to aid stability when cleaning the water surface, it is presently preferred that the body lift weight and/or buoyancy out of the water as it rises. The vertical lifting force is preferably developed in line with the center of gravity of the body 6 at its operating height. It is desirable to position the weight and/or buoyancy that comes out of the water around and away from the center of gravity so that the body is stable on the water surface. For economy in production and shipping, the weight can be provided by filling empty weight cavities in the body with water prior to operation. Such weight cavities can be filled via a tube which permits water to trickle from a pressurized supply flow into each cavity during operation. A suction or negative pressure embodiment can use pump suction to draw a trickle of water though a small hole in the bottom of each weight cavity.

Floating the body to the water surface can be accomplished by drawing air into flotation cavities via a small tube. A suction cleaner can use pump suction to draw the water out of the cavities and pull air in. In order to prevent air from entering the pool pump, a flexible plastic bag could be placed in each floatation cavity connected to the air tube. Water would never enter the air tubing or bags. As water is pulled out of the cavities, air is pulled into the bags; thus, floating the body. A pressure cleaner can use a pressurized water powered jet pump to draw water out of the cavities and/or pull or pump air into the cavities.

The mode controller 14A, in addition to controlling level control element 14D, also controls cleaning control element 14E. When in the water surface mode, element 14E, e.g., a valve, causes skimming action and may additionally allow a whip hose to sweep the wall surface. When in the wall surface mode, element 14E, preferably causes wall surface vacuuming and/or sweeping. General considerations for wall surface cleaning can be summarized as follows:

Positive Pressure Cleaner

1. The wall surface can be vacuumed using a source of pressurized water to power a liquid/liquid jet pump with a nozzle, a suction opening in close fluid communication with the wall surface to be cleaned, a tubular throat section, and a porous collection means (bag or container) coupled downstream of the throat section outlet to collect debris; or 2. A jet pump can be used to evacuate a container containing a porous collection means, having an opening in close fluid communication with the wall surface to be cleaned; or 3. A travelling body can scoop up debris in its path in a porous collection means. Scooping performance can be enhanced by water jetted in the direction of water flow relative to the body.

Water exiting from the body can provide thrust for propulsion and/or holding the device proximate the wall surface to be cleaned.

Negative Pressure Cleaner

1. Pump provided suction can draw water through a porous collection means which may be positioned along the suction hose length, in the fixed skimmer, in the pump inlet, or within the pool cleaner body. The water and debris may pass through a turbine on its way to the collection means and pump inlet.

2. A suction powered travelling cleaner can scoop up debris in its path in a porous collection means. Scooping performance can be enhanced by using pump suction or pump suction can draw water through a turbine to power a water flow generating device, such as a pump or propeller to increase the flow of water and debris through the porous collection means. Water exiting from such a device can provide thrust for propulsion and/or holding the device proximate to the surface to be cleaned.

In order to provide the traction means 11, e.g., wheels, with sufficient frictional contact with the wall surface to enable the body to move with the desired degree of directional consistency and to keep the sweep hose and/or the inlet to the debris collection means in close proximity to the wall surface, it is desirable to produce a hold down force in a nominally vertical direction relative to the body 6 to urge the body, i.e., traction means, against the wall surface. This hold down force can be provided by the submerged weight of the body if the vessel floor is relatively flat and the walls are not to be climbed. Otherwise, water flow away from the body having a sufficient directional component perpendicular to the wall surface and/or the pressure differential caused by the surface being in close proximity to the debris path can provide a sufficient hold down force.

General considerations for water surface cleaning can be summarized as follows:

Positive Pressure Cleaner

1. The water surface can be skimmed using a source of pressurized water to power a liquid/liquid jet pump which draws water and debris on the pool surface past a weir and a porous collection means; or 2. A source of pressurized water can power a nozzle which discharges a water jet to entrain surface water and debris into a porous collection means; or 3. A travelling body can scoop up debris in its path in a porous collection means. Scooping performance can be enhanced by entrainment caused by pressurized water jetted in the direction of water flow through the device.

Water exiting from the body can provide thrust for propulsion or lift.

Negative Pressure Cleaner

1. Pump powered suction can draw water and debris from the water surface past a weir and a porous collection means; or 2. Pump powered suction can draw water from a chamber with an open or closed top and at least partially open side (at or just below the water surface for allowing the chamber to remain in flooded condition essentially up to the pool water surface as a result of surface water and debris entering said chamber) through a porous debris collection means. The collection means can be in said chamber; or 3. Pump powered suction can draw water though a turbine to power a water flow generating device, such as a pump or propeller, etc., which can propel surface water and debris through a porous debris collection means; or 4. Pump suction can propel a body to allow it to scoop up debris in its path in a porous collection means. Scooping can be enhanced by using pump suction or pump suction powered flow generating device to increase the flow of water and debris through the porous collection means.

Water exiting from the body can provide thrust for propulsion or lift.

FIG. 2 also shows the propulsion control subsystem 16 which includes a propulsion state controller 16A capable of selectively defining either a first state (normal) or a second state (backup). The state of controller 16A is determined usually by an event sensor 16B which can respond, for example, to the expiration of a time interval or to some other event such as the interruption of body motion. Thus, for example, in typical operation, the body 6 will operate in the normal propulsion state being propelled in a forward direction for say two to five minutes, and then will be switched to the backup state for perhaps 30 seconds, and then will be returned to the normal state. These timing intervals are preferably separately optimized for each different installation. By periodically switching to the backup state, the possibility of the body getting stuck behind some obstruction in the vessel is minimized. The normal toggling of controller 16A can be overridden by a user control 16C.

The controller 16A controls a direction control element 16D, e.g., a valve, which develops a forward propulsion force during the normal state and a rearward propulsion force during the backup state. These forces include force components nominally horizontally oriented relative to the body 6 to enable the body to be propelled along the water surface (during the water surface cleaning mode) and along the side and bottom positions of the wall (during the wall surface cleaning mode).

An optional steering mechanism 16E can be incorporated to vary the direction of the forward and/or rearward propulsion force components to better randomize the body's travel path. This steering action can include the selective utilization of side thrust water discharge.

More particularly, on both the water surface and wall surface, the body should be able to travel forward, rearward, and to the left and to the right. This can be accomplished by using contact with the pool contours to randomly redirect the body's travel. Skewing the thrust direction to the axis of the cleaner can bias the travel path for a particular pool. However, to minimize the possibility of the cleaner getting stuck, e.g., in a corner, it is desirable that the cleaner periodically go backward. In addition, to assure complete cleaning coverage, it is preferable to be able to turn to the left and to the right at predetermined intervals, as for example, by selectively discharging the side thrust flows.

A timing assembly with a water flow powered turbine driving a gear train can be designed to provide the desired travel path sequence. A variable flow control in the water flow line to the turbine can be adjusted by the user to vary the timing cycle length, e.g., longer for larger pools, shorter for smaller pools.

In order to alter the body travel direction, the thrust direction must be changed. One way to do this is to move a rudder and/or a wheel, or a jet nozzle, or the discharge of a jet pump, or by redirecting water flow generated by a pump or a propeller relative the axis of the cleaner. Another way is to have the timing assembly alter the direction of the thrust by operating a steering valve or valves to create a sequence of pressurized water discharge through differently directed nozzles and/or jet pumps.

A third steering method can use the output of the timing assembly to change the directional relationship between the body and the hose supplying pressurized water or drawing water from the body. If the thrust direction relative to the body remains fixed, and the supply hose has mass and stiffness, the torque created by the timing assembly will alter the direction of body travel. In this case, since the hose typically exits from the body horizontally, the body can rotate less than 360 degrees relative to the hose in a first direction and then rotate a like amount in the opposite direction. This can be accomplished by having rotation limits which cause the timing assembly output to reverse direction when said limits are contacted. The timing assembly output can be reversed by changing the turbine flow direction, by shifting gears, or by providing water flow to a second turbine that rotates in the reverse direction.

General considerations regarding propulsion can be summarized as follows:

1. The body 6 can be propelled by various means including: turbine driven traction means, walking mechanisms, oscillating mechanisms that cause intermittent water flow, imparting kinetic energy that causes motion, and thrust, which is a reactive force that moves the body in a direction opposite to the direction that water exits from the body. All of these propelling means can be powered by either positive or negative pump produced pressure. Thrust is the presently preferred technique because of its relative simplicity and its applicability to both surface and underwater propulsion.

Thrust can also create forces up, down, left, right and back for moving the device on the wall surface, on the water surface, and from one surface to the other.

Positive Pressure Cleaner

1. Pressurized water can be jetted from a nozzle as a high velocity low mass stream to create thrust in the opposite direction. The magnitude of the thrust produced is a function of the water mass multiplied by its velocity.

2. The pressurized water powered nozzle can be part of a liquid/liquid jet pump which pumps pool water to create a much larger mass and lower velocity water stream with greater thrust from the same water source.

Negative Pressure Cleaner

Pump suction is used to drive a flow generator to produce thrust. A turbine driven by water drawn through it by pump suction can drive oars, a swimming mechanism, a pump, or a propeller which can move a large mass of pool water at low velocity and which can efficiently produce thrust for a given amount of energy input.

First Embodiment (FIGS. 3–8)

Attention is now directed to FIGS. 3–8 which depict a first embodiment 100 of the invention designed to be powered from the positive pressure side of a motor driven hydraulic pump via a hose 9 (FIGS. 1A, 1B). The embodiment 100 is comprised of a unitary body 102 which is primarily formed of upper and lower molded sections 102U and 102L. Lower body section 102L supports three parallel axles 104A, 104B, 104C. Traction wheels 106A, 106B, 106C are mounted for free rotation on axles 104A, 104B, 104C respectively for tangentially engaging interior wall surface 8 (FIGS. 1A, 1B). The body 102 defines an inlet supply fitting 110 which is coupled to the distal end of supply hose 9. The proximal end of hose 9 is coupled to the pressure outlet of pump 10.

Figure 8:
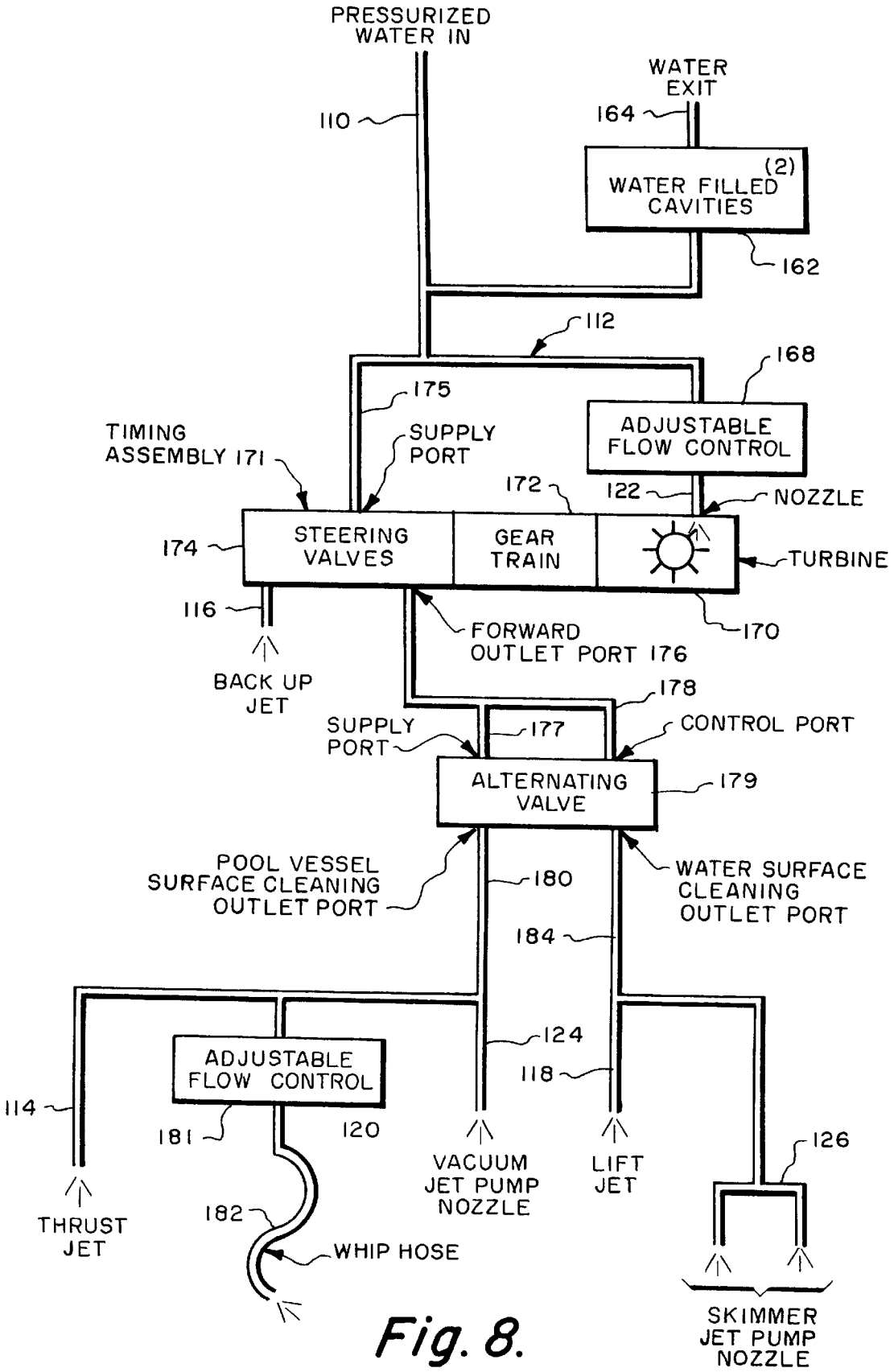
FIG. 8 is a flow diagram describing the operation of the embodiment of FIGS. 3–8.
Figure 9:
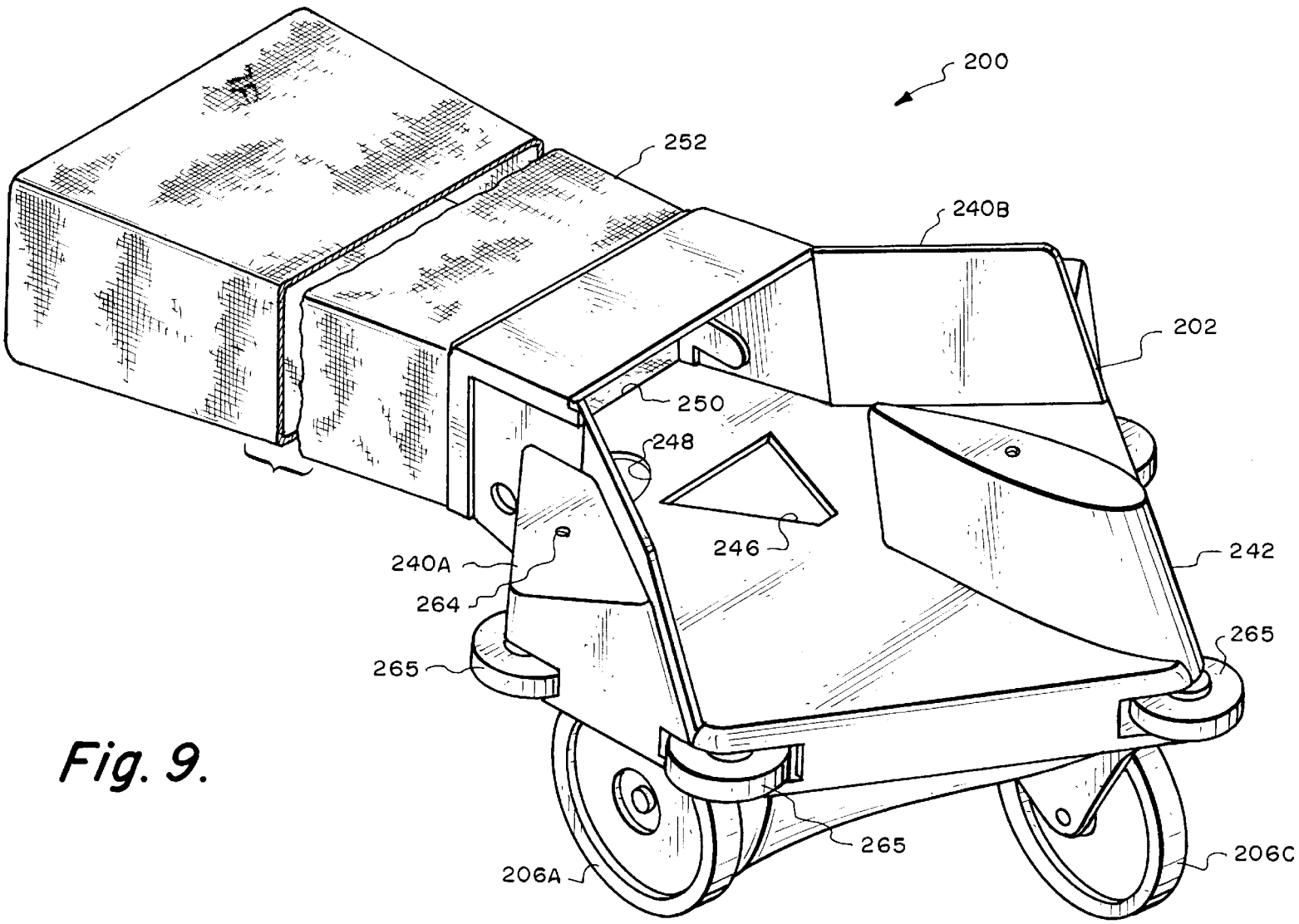
FIGS. 9–14 illustrate a second structural embodiment of the invention capable of selectively operating in (1) a water surface cleaning mode and (2) a wall cleaning mode.
Figure 10:
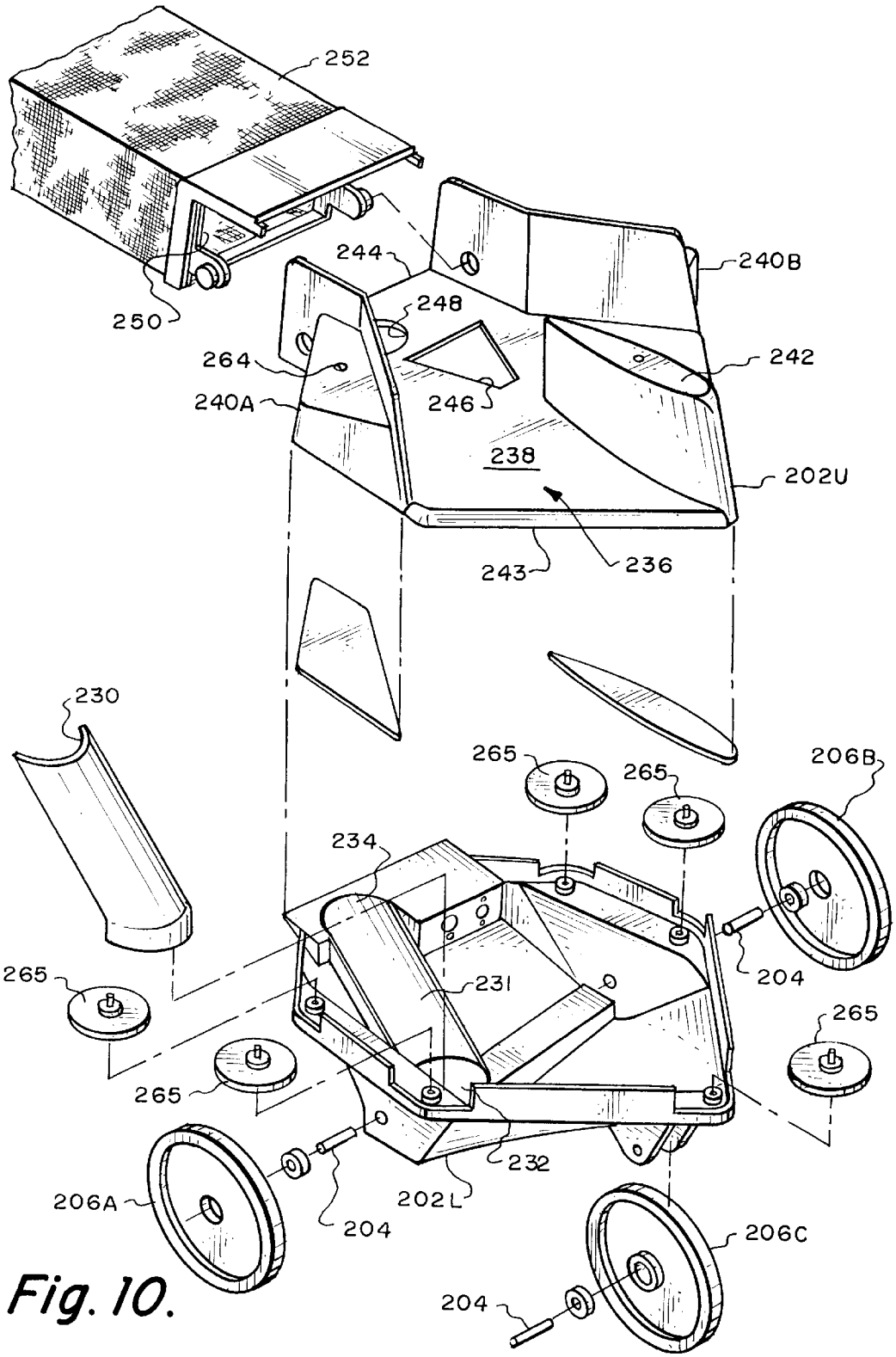
Figure 11:
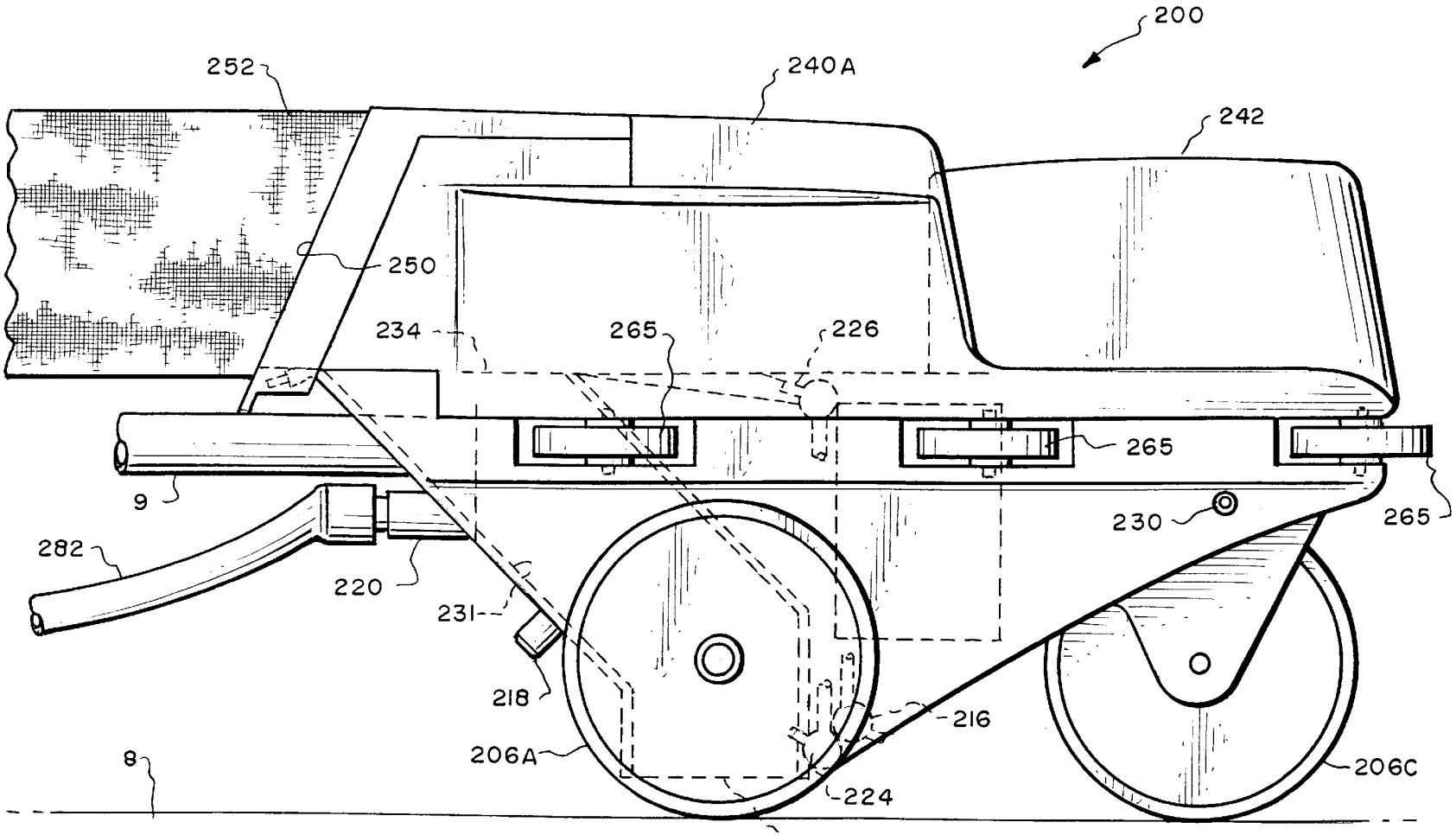
Figure 12:
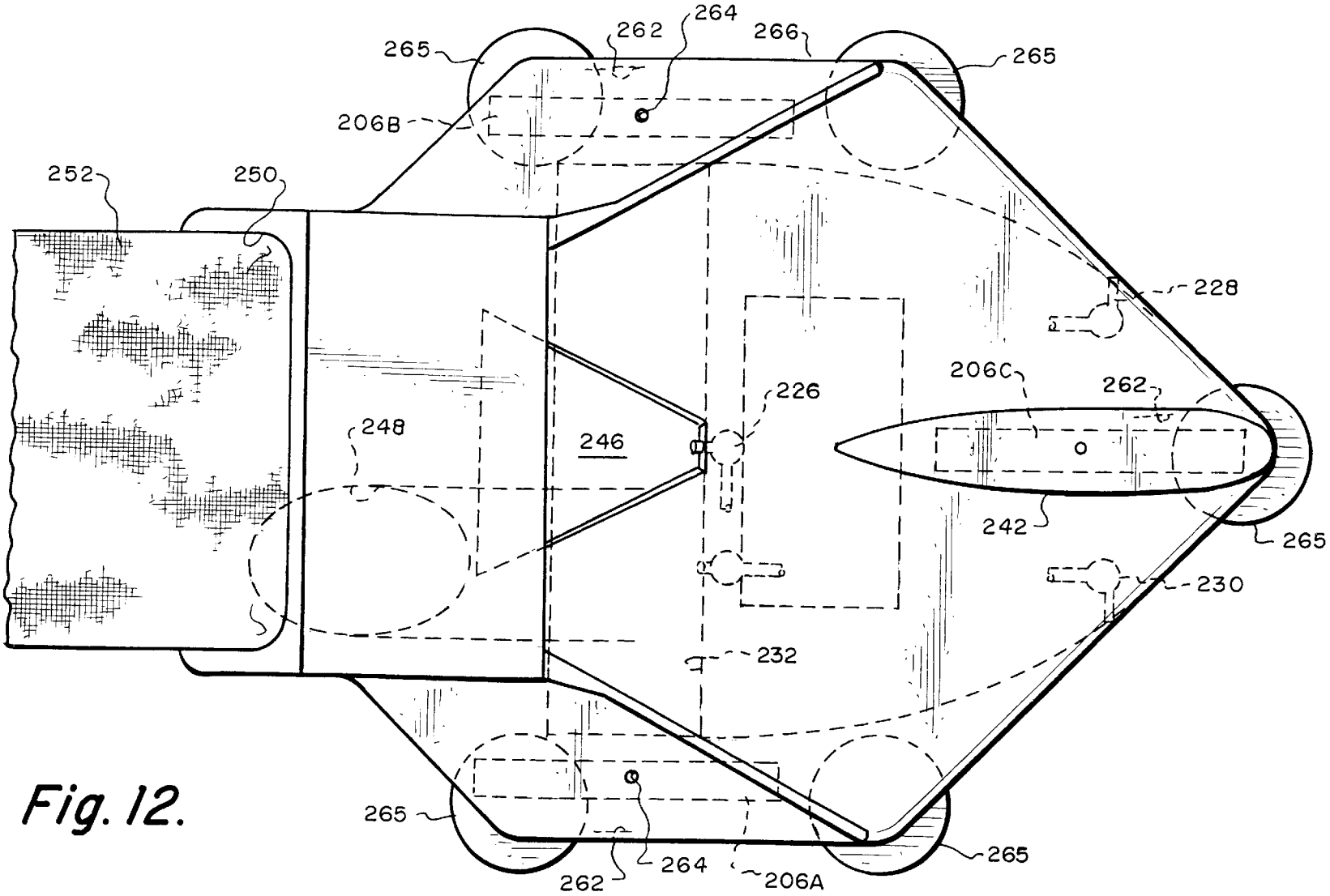
Figure 13:
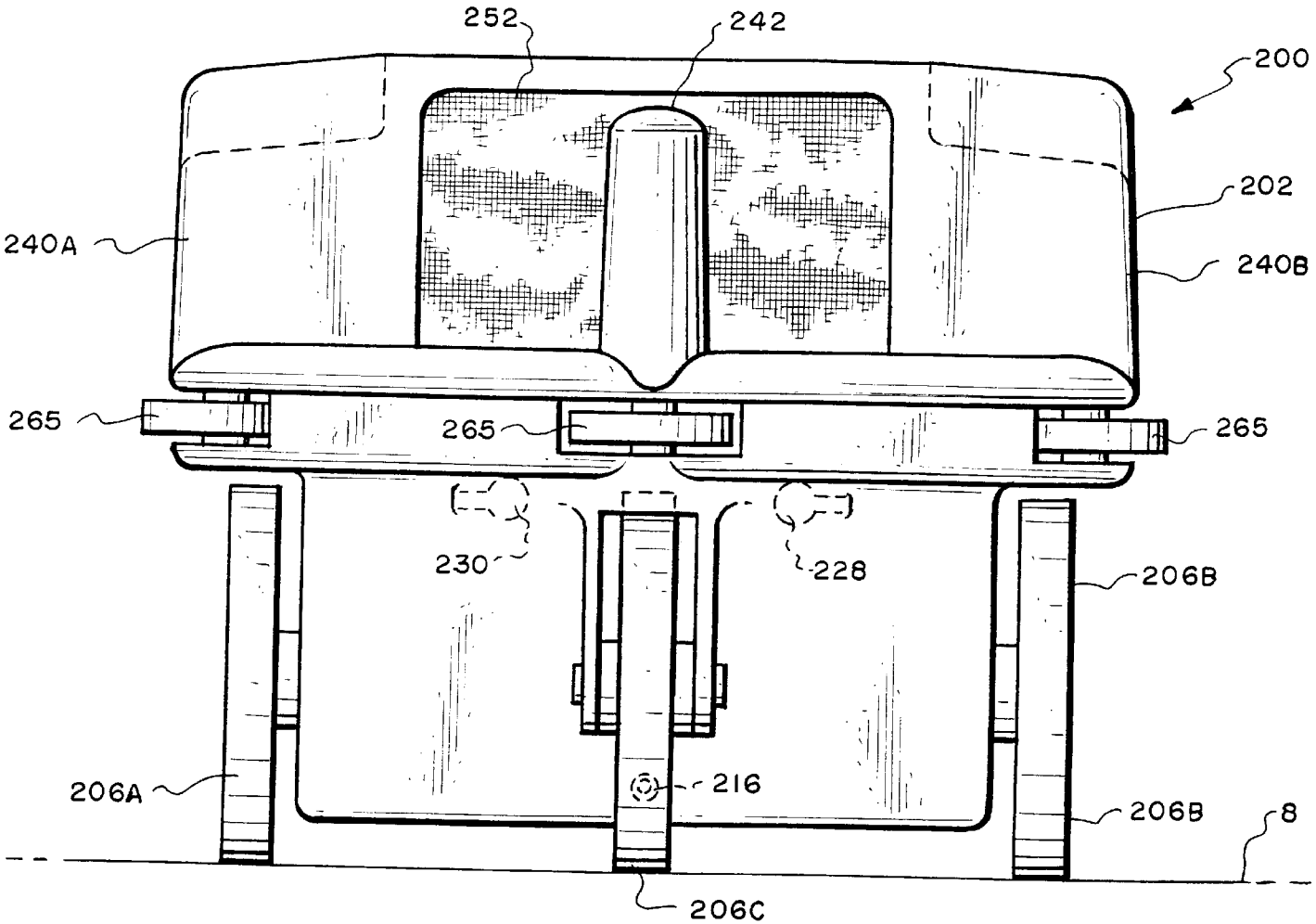
Figure 14:
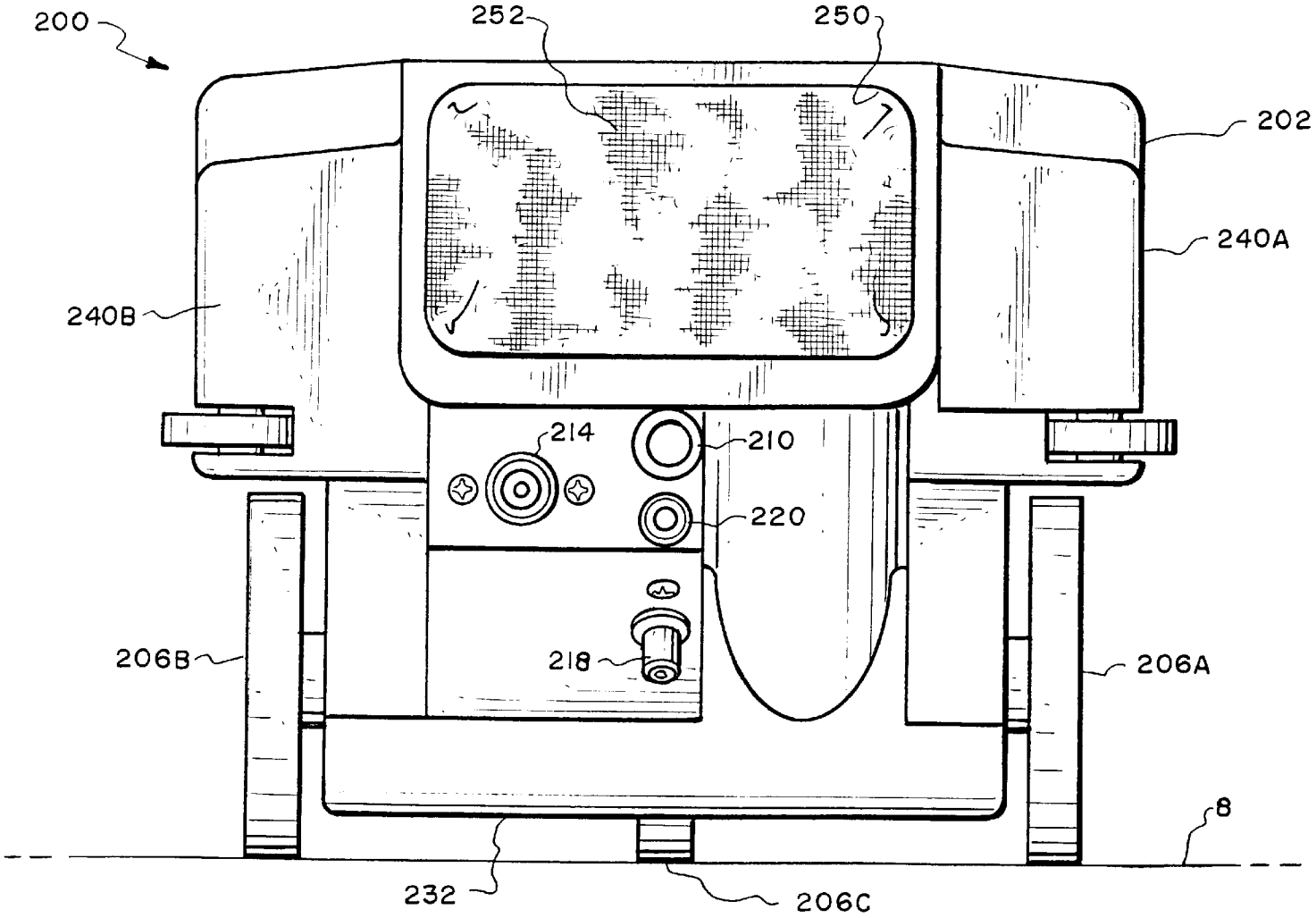

The water flow supplied to inlet fitting 110 from pump 10 is distributed to a plurality of outlets carried by body 102 by tubing 112 (best depicted in FIG. 8, omitted from FIGS. 3–7 for clarity purposes). The plurality of outlets include:

1. forward propulsion thrust jet 114
2. rearward ("backup") propulsion thrust jet 116
3. lift jet 118
4. sweep hose 120
5. timing nozzle 122
6. vacuum jet pump nozzle 124
7. skimmer jet pump nozzles 126

The body 102 is configured to define a collection path 130 for wall surface debris which extends from a vacuum inlet opening 132 (positioned between wheels 106A and 106B close to the wall surface 8) and a vacuum discharge opening 134 (positioned proximate to the body rear portion 102R below the supply inlet fitting 110) The vacuum jet pump nozzle 124 discharges a high velocity flow into the path 130 toward the discharge opening 134. This action produces a suction at the vacuum inlet opening 132 which draws water and debris from adjacent to wall surface 8 and discharges it through discharge opening 134. The vertical component of the water drawn in through vacuum inlet opening 132, together with the weight of the unit, creates a hold down force acting to urge the traction wheels 106 against the wall surface 8.

The body 102 also defines a collection path 136 for surface water and debris. More particularly, the body 102 defines an open skimmer chamber 138 having an entrance 140 positioned between semi-cylindrical projections 142A, 142B. A weir 143 having sides 144A, 144B is mounted adjacent to the entrance 140 positioned between the projections 142A, 142B. The weir 143 is mounted for reciprocal vertical motion relative to the body so that when the body is floating proximate to the water surface, surface water will flow or spill over the weir sides 144A, 144B into the open skimmer chamber 138. The path 136 extends from the entrance 140, through the chamber 138, to a discharge opening 146 positioned adjacent to discharge opening 134 proximate to the body rear portion 102R below the supply inlet fitting 110. The skimmer jet pump nozzles 126 discharges a high velocity flow into path 136 toward the discharge opening 146. This action produces a suction which draws water and debris from chamber 138 and discharges it through discharge opening 146.

The open mouth 150 of a debris collection container or bag 152 is detachably mounted around discharge opening 134 and 146. The bag 152 is preferably formed of water permeable material for the side and bottom panels 154 to permit the water from the discharge openings 134, 146 to flow through the bag. The top and rear panels 156, 158 are preferably formed of impermeable material to discourage an upward flow of water out of the bag 152 which would create an unwanted downward thrust.

Each of the aforementioned projections 142A, 142B is defined by a semi-cylindrical wall 158, which together with a lid 160, encloses a cavity 162. As will be shown hereinafter, each cavity 162 fills with water to the level of its lid 160. Each lid 160 has an overflow hole 164. The water filled cavities provide ballast for stability near the water surface. The body can be thrust to the water surface by a downward flow exiting from the lift jet outlet 118. When the body reaches the ambient air/water surface boundary, the weight of water in the two cavities 162 being lifted above the water surface reaches equilibrium with the thrust produced by jet 118 to establish an operating level appropriate for skimming action by weirs 143.

The body lower section 102L preferably carries one or more guard wheels 165 mounted for rotation on a vertical axis for facilitating movement around obstructions.

Particular reference is now called to FIG. 8 which schematically depicts the water flow through the embodiment 100 structurally depicted in FIGS. 3–7. Note that water entering the inlet 110 initially fills weight cavities 162 and may exit through overflow holes 164. The water entering water inlet 110 is also directed to the aforementioned timing nozzle 122, preferably via an adjustable flow control 168 for driving a turbine 170. The turbine 170 forms part of a timing assembly 171 which includes a gear train 172 controlling a steering valve 174. The steering valve 174 can define either the aforementioned normal propulsion state or back-up propulsion state. When the steering valve 174 is in the back-up state, water supplied to port 175 is discharged via the rearward propulsion thrust jet 116 to move the body rearwardly. When the steering valve 174 is in its normal state, the water supplied to port 175 exits via forward outlet port 176. The flow from port 176 is supplied to supply port 177 and control port 178 of an alternating level control valve 179. The valve 179 is capable of selectively defining either a wall surface cleaning mode or a water surface cleaning mode. When in the wall surface cleaning mode, the water flow to supply port 177 is discharged via outlet port 180 to the vacuum jet pump nozzle 124, the forward propulsion thrust jet 114, and the sweep hose outlet 120. The outlet 120 is preferably connected to an adjustable flow control 181 which supplies one end of a whip or sweep hose 182. When the level control valve 179 is in the water surface cleaning mode, the water flow supplied from port 177 to valve 179 is directed via outlet port 184 to the lift jet 118 and to a pair of skimmer jet pump nozzles 126. Although not represented in FIG. 8, a water flow can also be provided to the sweep hose 182 in the water surface cleaning mode to enable the sweep hose 182 to hang below the body 102 and sweep against the wall surface, e.g., steps.

The initiation of a flow from outlet port 176 to control port 178 is used as the event to switch the state of level control valve 179. Thus, for example, each time the steering valve 174 initiates a flow out of port 176, it will switch the mode from wall surface cleaning to water surface cleaning or vice versa. Different events could, of course, be used to toggle level control valve 179. Additionally, it can be recalled from FIG. 2 that in some installations it may be desirable to incorporate a user input control for setting or overriding the event sensor mechanism which normally controls the valve 179 during automatic operation.

In typical automatic operation of the embodiment 100, the body 102 will be propelled forwardly along the wall surface 8 by the discharge from directionally adjustable jet 114 for a certain period of time, e.g., two to five minutes. Its direction will be randomly influenced by the contours of the vessel, the drag of supply hose 9, the influence of sweep hose 182, etc. After a certain interval, the steering valve 174 will change state and the unit will backup as a consequence of discharge from the rearward propulsion thrust jet 116. After a further interval, e.g., thirty seconds, the valve 174 will change state.

Second Embodiment (FIGS. 9–15)

Attention is now directed to FIGS. 9–15 which depict a second embodiment 200 of the invention designed to be powered from the positive pressure side of a motor driven hydraulic pump 10 via a hose 9 (FIGS. 1A, 1B). The embodiment 200 is comprised of a unitary body 202 which is primarily formed of upper and lower molded sections 202U and 202L. Lower body section 202L supports three horizontally oriented parallel axles 204 on which traction wheels 206A, 206B, 206C are mounted for free rotation for tangentially engaging interior wall surface 8 (FIGS 1A, 1B). The body 202 defines an inlet supply fitting 210 which is coupled to the distal end of supply hose 9. The proximal end of hose 9 is coupled to the pressure outlet of pump 10.

Figure 15:
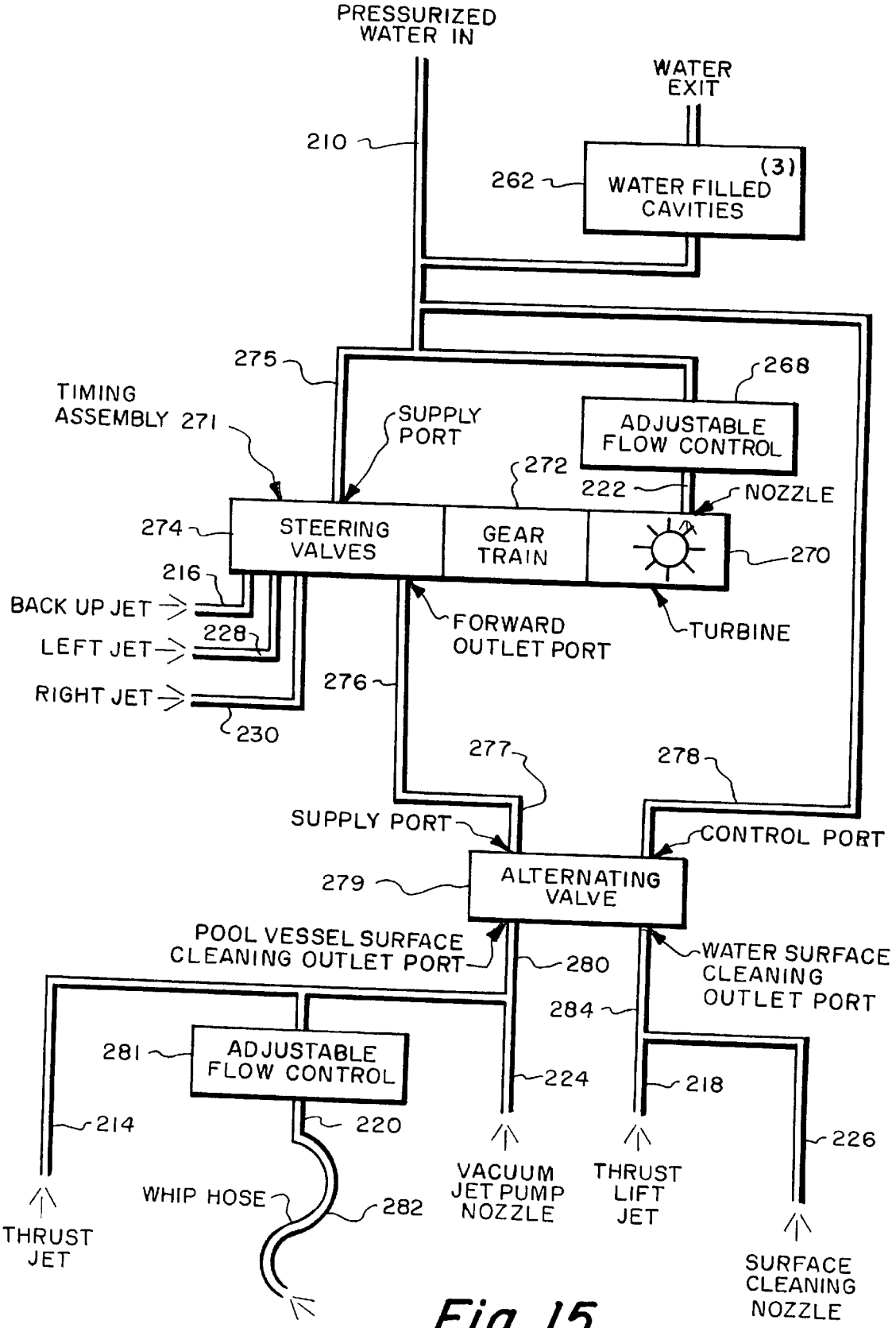
FIG. 15 is a flow diagram describing the operation of the embodiment of FIGS. 9–14.

The water flow supplied to inlet fitting 210 from pump 10 is distributed to a plurality of outlets carried by body 202 by tubing 212 (best depicted in FIG. 15, omitted from FIGS. 9–14 for clarity purposes). The plurality of outlets include:

1. forward thrust jet 214
2. rearward ("backup") thrust jet 216
3. thrust/lift jet 218
4. sweep hose 220
5. timing nozzle 222
6. vacuum jet pump nozzle 224
7. surface cleaning nozzle 226
8. left jet 228
9. right jet 230

The body 202 is configured to define a collection path 230 for wall surface debris which extends from a vacuum inlet opening 232 (positioned between wheels 206A and 206B close to the wall surface 8) and a vacuum discharge opening 234. The vacuum jet pump nozzle 224 discharges a high velocity flow into the path 230 toward the discharge opening 234. This action produces a suction at the vacuum inlet opening 232 which draws water and debris from adjacent to wall surface 8 and discharges it through discharge opening 234. The vertical component of the water flowing through path 230, together with the weight of the unit, creates a hold down force acting to urge the traction wheels 206 against the wall surface 8.

The body 202 also defines a collection path 236 for surface water and debris. More particularly, the upper body section 202 defines a horizontal shelf surface having upstanding side walls 240A, 240B and a central upstanding fin 242. As the body moves forward through the water pool near the surface, surface water and debris are scooped up moving rearwardly over surface 238 between side walls 240A, 240B. The collection path 236 extends from the leading edge 243 of surface 238 to a trailing edge 244. The surface 238 defines a cutout 246 below which the aforementioned surface cleaning nozzle 226 is mounted. The nozzle 226 discharges a flow through cutout 246 into path 236 toward the trailing edge 244. This action facilitates the flow of water and debris over surface 238 from the leading to the trailing edge thereof.

Note also that discharge opening 234 of collection path 230 also opens onto shelf 238 via cutout 248 just upstream from the trailing edge 244.

The open mouth 250 of a debris collection container or bag 252 is detachably mounted adjacent to trailing edge 244 between upstanding sidewalls 240A, 240B. The bag 252 is preferably formed of water permeable material to permit water flowing rearwardly from the shelf 238 to flow through the bag.

The aforementioned upstanding walls 240A, 240B, as well as central fin 242 each enclose a cavity 262. As will be shown hereinafter, each cavity 262 fills with water to the level of an overflow hole 264. The water filled cavities provide ballast for stability near the water surface. The body can be thrust to the water surface by a downward flow exiting from the thrust/lift jet outlet 218. When the body reaches the ambient air/water surface boundary, the weight of water in the cavities 262 being lifted above the water surface reaches equilibrium with the thrust produced by jet 218 to establish an operating level appropriate for skimming action over shelf 238.

The body 202 preferably carries a plurality of guard rollers 265 each mounted for rotation about a vertical axis. The rollers 265 are distributed around the periphery 266 of body 202 and facilitate the body's movement around obstructions.

Particular reference is now called to FIG. 15 which schematically depicts the water flow through the embodiment 200 structurally depicted in FIGS. 8–12. Note that water entering the inlet 210 initially fills weight cavities 262 and is also directed to the aforementioned timing nozzle 222, preferably via an adjustable flow control 268 for driving a turbine 270. The turbine 270 forms part of a timing assembly 271 which includes a gear train 272 controlling a steering valve 274. The steering valve 274 can define either the aforementioned normal propulsion state or back-up propulsion state. When the steering valve 274 is in the back-up state, water supplied to port 275 is discharged via the rearward propulsion thrust jet 216 to move the body rearwardly. Additionally, water can be selectively discharged through left and right jets 228, 230 to facilitate the body freeing itself from any encountered obstructions. These same side thrust jets are also preferably used in the normal propulsion state to better randomize travel and escape obstructions.

When the steering valve 274 is in its normal state, the water supplied to port 275 exits via forward outlet port 276. The flow from port 276 is supplied to supply port 277 of an alternating level control valve 279.

The valve 279 is capable of selectively defining either a wall surface cleaning mode, or a water surface cleaning mode. The valve mode is switched whenever a flow to control port 278 is initiated. As shown in FIG. 15, the flow to control port 278 is derived from supply inlet 210. Accordingly, whenever the pump 10 supplying inlet 210 starts up, the mode of valve 279 changes.

Although FIG. 15 depicts the initiation of a flow to control port 278 from inlet 210 as the triggering event to switch the level control valve 279 mode, other events could, of course, be used to toggle valve 279. Moreover, it should be recalled from FIG. 2 that it may be desirable to incorporate a user input control for setting or overriding the event sensor which normally controls the automatic operation of valve 279.

When in the wall surface cleaning mode, the water flow to supply port 277 is discharged via outlet port 280 to the vacuum jet pump nozzle 224, the forward propulsion thrust jet 214 (preferably directionally adjustable), and the sweep hose outlet 220. An adjustable flow control 281 is preferably connected just upstream of the sweep hose outlet 220. When the level control valve 279 is in the water surface cleaning mode, the water flow supplied from port 277 to valve 279 is directed via outlet port 284 to the thrust/lift jet 218 and to the aforementioned surface cleaning nozzle 226. Although not represented in FIG. 8, a water flow can also be provided to the sweep hose 220 in the water surface cleaning mode to enable the sweep hose outlet to hang below the body 202 to sweep against portions of the wall surface.

In typical automatic operation of the embodiment 200, the body 202 will be propelled along the wall surface 8 by the discharge from thrust jet 214 for a certain period of time, e.g., two to five minutes. Its direction will be randomly influenced by the contours of the vessel, the drag of supply hose 9, the influence of sweep hose 282, etc. When the timing assembly changes the steering valve 274 state, the unit will backup as a consequence of discharge from the rearward propulsion thrust jet 216 for a certain interval, e.g., thirty seconds, before resuming its normal state. As represented in FIG. 15, the alternating valve 279 will periodically switch modes independently of timing assembly 271 in response to a triggering event, such as the cycling of pump 10.

The following Table I list the primary characteristics of a typical unit corresponding to embodiment 200:

Types of pools cleaned: All inground and above ground pools
Power source: Booster pump and/or pool pump
Wheels—number / diameter: 3 wheels / 4" diameter
Debris collected in: Mesh bag
Wall Cleaning: Vacuum & sweeps
Vacuum jets: 1
Vacuum minimum diameter: 2"
Vacuum opening width: 7.1"
Sweeping: Whip hose
Propulsion: 1 thrust jet
Wall surface travel path: Forward and left, straight, right, straight and random. Back and up to the left and right.
Water surface cleaning: Skims
Surface cleaning jets: 1

Opening width: 9.5"
Debris collection bag opening: 3" high×5" wide
Propulsion: 1 thrust/lift jet
Water surface travel path: Forward and left, straight, right, straight and random. Back and down to the left and right Third Embodiment (FIGS. 16–20)

Figure 16:
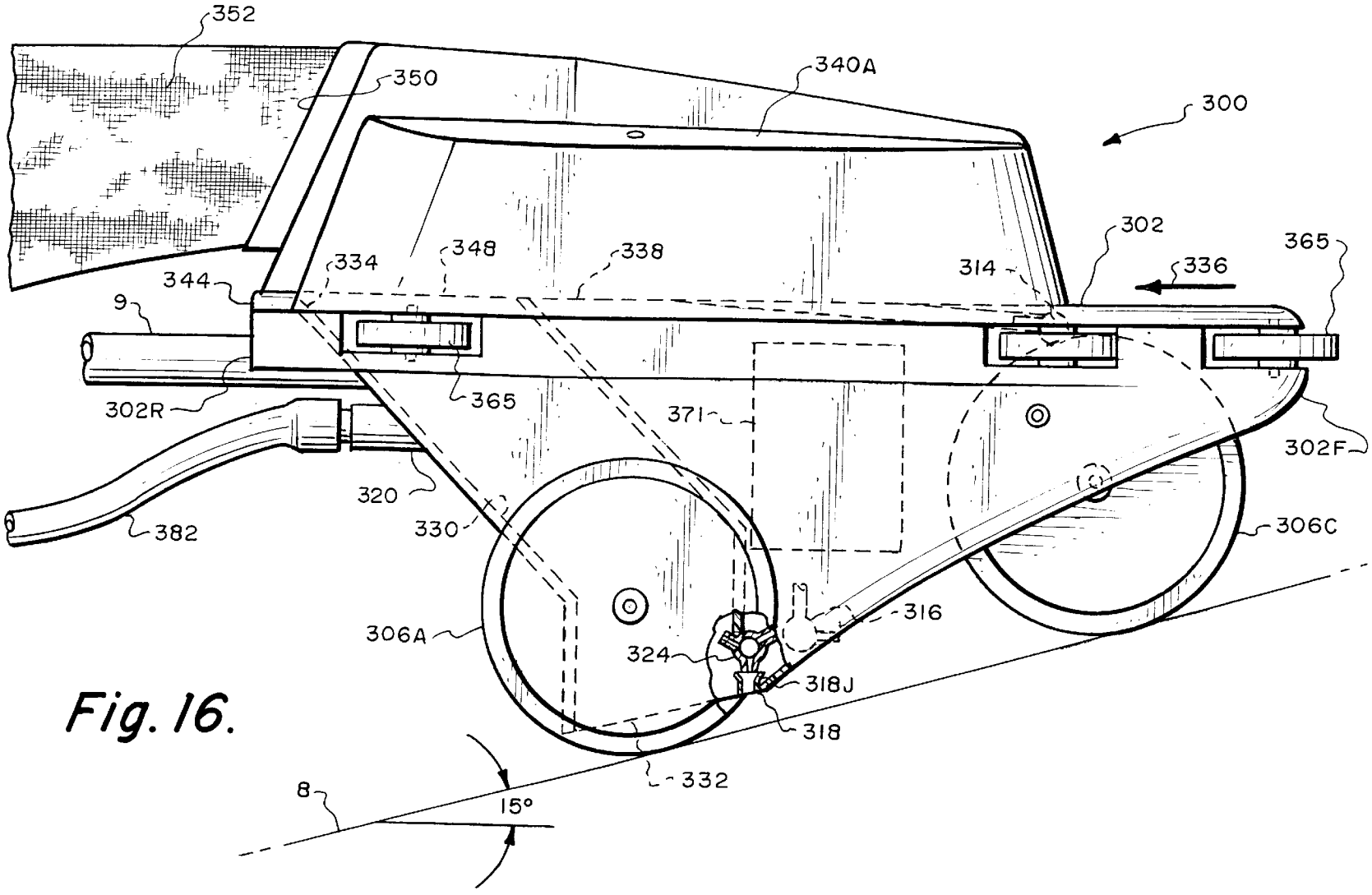
FIGS. 16–19 illustrate a third structural embodiment of the invention capable of selectively operating in (1) a water surface cleaning mode and (2) a wall cleaning mode.

Attention is now directed to FIGS. 16–20 which depict a third embodiment 300 of the invention designed to be powered from the positive pressure side of a motor drive hydraulic pump 10 via a hose 9 (FIGS. 1A, 1B). The embodiment 300 is comprised of a unitary body 302 supported on three traction wheels 306A, 306B, 306C mounted for free rotation on horizontal axles for tangentially engaging interior wall surface 8. The traction wheels are arranged to essentially orient the nose or front 302F of the body down about 15 degrees relative to the rear 302R of the body, as shown in FIG. 16.

The body 302 is provided with an inlet supply fitting 310 which is coupled to the distal end of supply hose 9. The proximal end of hose 9 is coupled to pressure outlet of pump 10.

Figure 20:
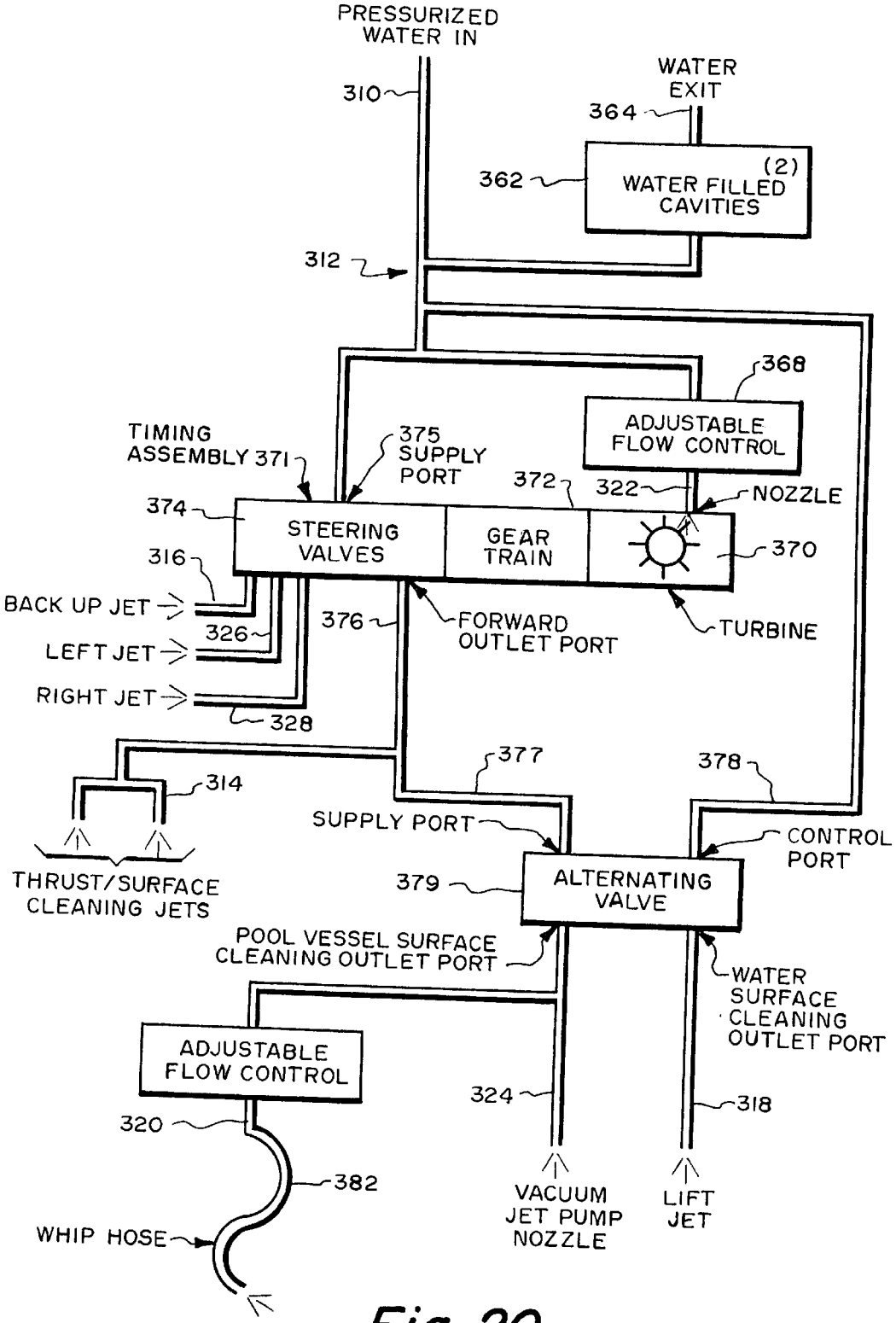
FIG. 20 is a flow diagram describing the operation of the embodiment of FIGS. 16–19.
Figure 21:
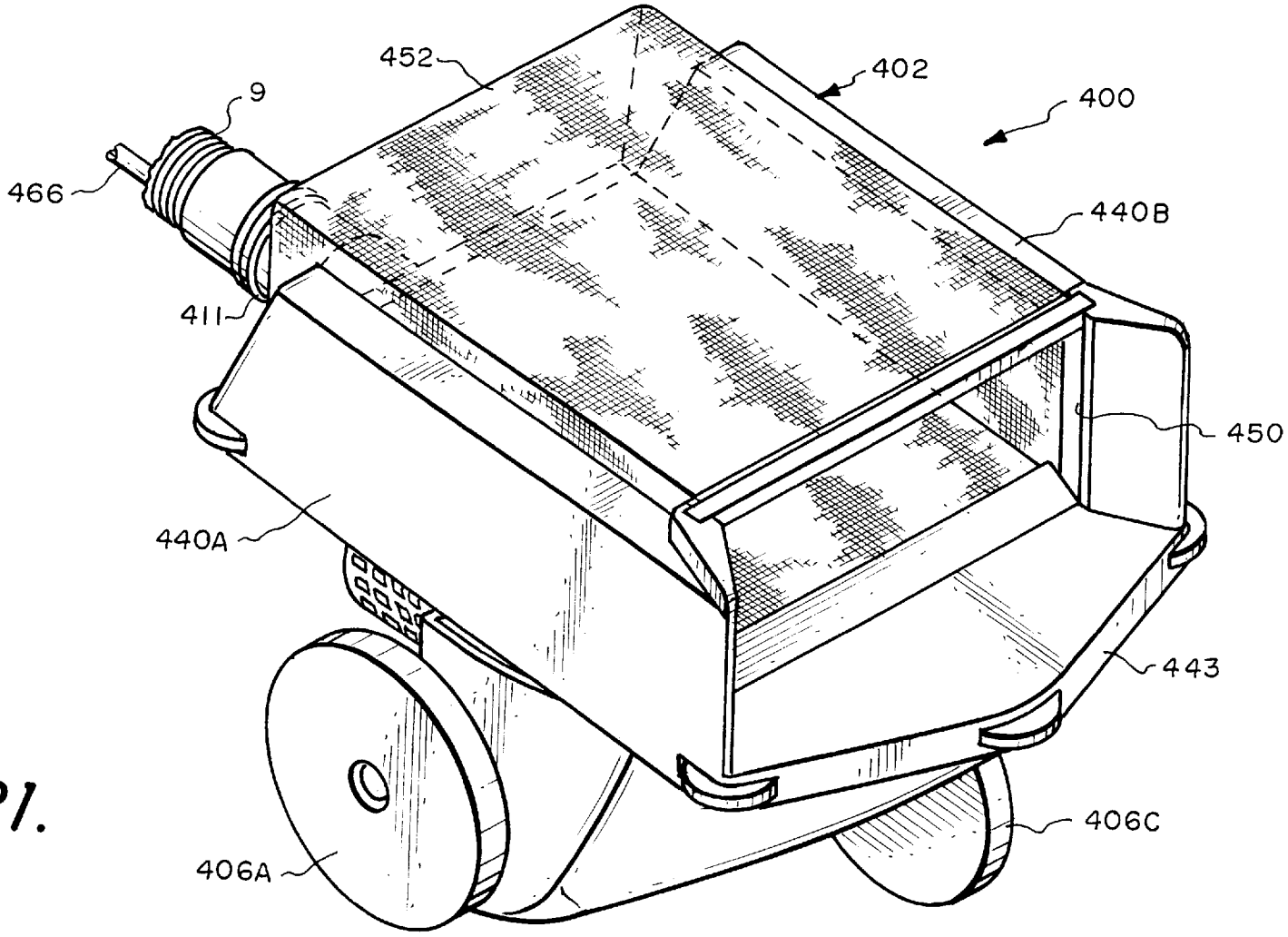
FIGS. 21–26 illustrate a fourth structural embodiment of the invention capable of selectively operating in (1) a water surface cleaning mode and (2) a wall cleaning mode.
Figure 22:
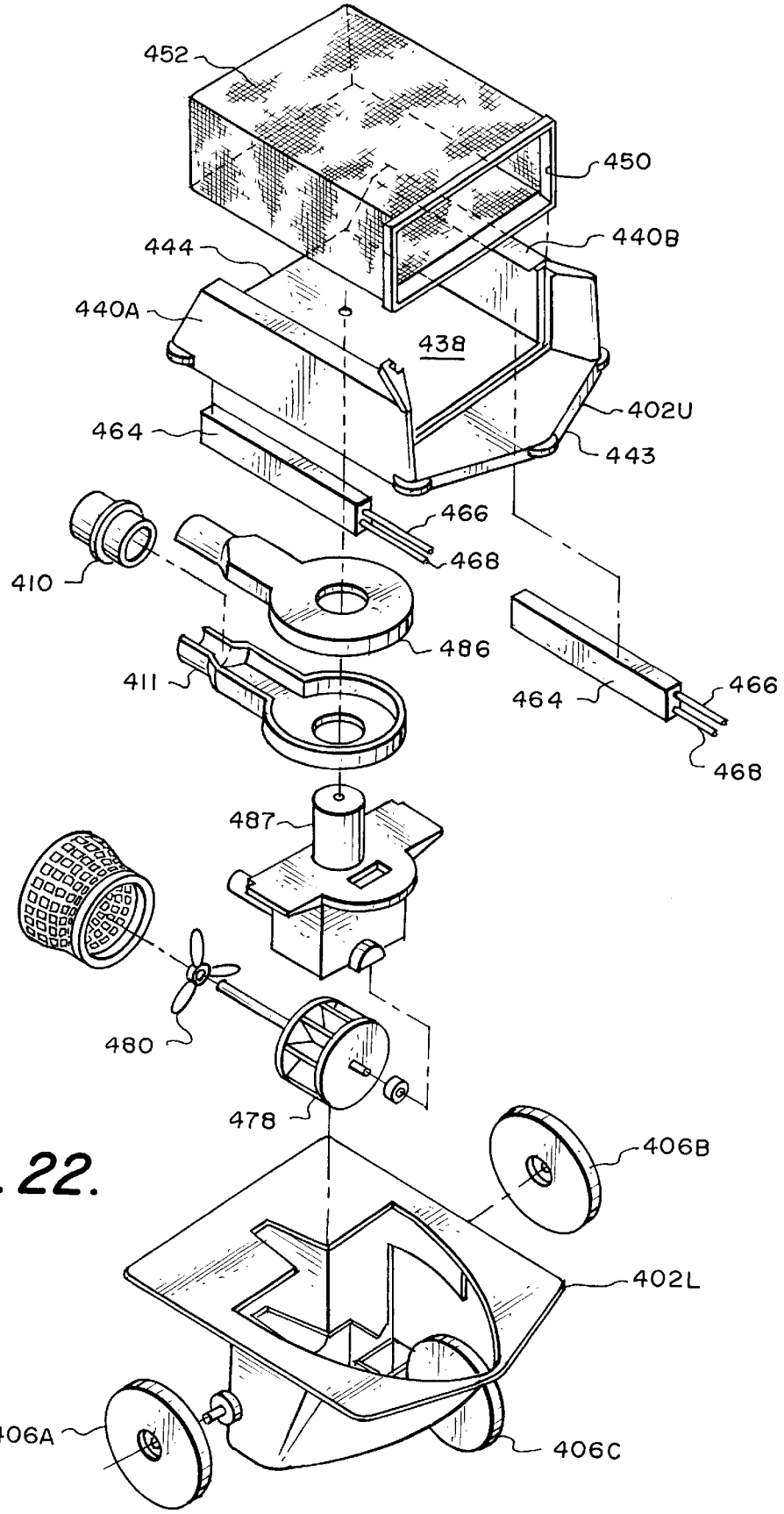

The water flow supplied to inlet fitting 310 from pump 10 is distributed to a plurality of outlets carried by body 302 by tubing 312 (best depicted in FIG. 20, omitted from FIGS. 16–19 for clarity purposes). The plurality of outlets include:

| | |
|---|---|
| 1. forward propulsion thrust/surface cleaning jets | 314 |
| 2. rearward ("backup") thrust jet | 316 |
| 3. lift jet | 318 |
| 4. sweep hose | 320 |
| 5. timing nozzle | 322 |
| 6. vacuum jet pump nozzle | 324 |
| 7. left jet | 326 |
| 8. right jet | 328 |

The body 302 is configured to define a collection path 330 for wall surface debris which extends from a vacuum inlet opening 332 (positioned between wheels 306A and 306B close to the wall surface 8) and a vacuum discharge opening 334. The vacuum jet pump nozzle 324 discharges a high velocity flow into the path 330 toward the discharge opening 334. This action produces a suction at the vacuum inlet opening 332 which draws water and debris from adjacent to wall surface 8 and discharges it through discharge opening 334. The vertical component of the water flow through path 330, together with the weight of the unit, creates a hold down force acting to urge the traction wheels 306 against the wall surface 8.

The body 302 also defines a collection path 336 for surface water and debris. More particularly, the body 302 defines a horizontal shelf surface 338 having upstanding side walls 340A, 340B. As the body moves forward through the water pool near the water surface, surface water and debris are scooped up moving rearwardly over surface 338 between side walls 340A and 340B. The collection path 336 extends from the leading edge 343 of surface 338 to a trailing edge 344. The surface 338 defines a cutout 348 aligned with the aforementioned discharge opening 334, just upstream from the shelf trailing edge 344.

The open mouth 350 of a debris collection container or bag 352 is detachably mounted to the body 302 proximate to the trailing edge 344 and spaced above the surface 338 as is best depicted in FIG. 16. The bag 352 is preferably formed of water permeable material to permit water flow therethrough.

The aforementioned upstanding walls 340A and 340B, each enclose a cavity 362. As would be shown hereinafter, each cavity 362 fills with water to the level of an overflow hole 364. The water filled cavities provide ballast stability when the body is at the water surface. The body can be thrust to the water surface by a downward flow exiting from lift jet 318. The jet 318 is able to lift the body to a level where the weight of water in the cavities 362 being lifted above the water surface reaches equilibrium with the thrust afforded by jet 318.

The body 303 preferably carries a plurally of guard rollers 365 each mounted for rotation about a vertical axis. The rollers 365 are distributed around the periphery 366 of body 302 and facilitate the body's movement around obstructions.

Particular reference is now called to FIG. 20 which schematically depicts water flow to the embodiment 300 structurally depicted in FIGS. 16–19. Note that the water entering the water inlet 310 initially fills weight cavities 362 and is also directed to the aforementioned timing nozzle 322, preferably via an adjustable flow control 368 for driving a turbine 370. The turbine 370 forms part of a timing assembly 371 which includes a gear train 372 controlling a steering valve 374 which can define either a normal propulsion state or a backup propulsion state. When the backup state is defined, water supplied to port 375 is discharged via the rearward propulsion thrust jet 316 to move the body rearwardly and/or to left and right jets 326, 328 to produce side thrust for freeing the body from any encountered obstructions. These same side thrust jets are also preferably used in the normal propulsion state to better randomize travel and escape obstructions.

When the steering valve 374 is in its normal state, the water supplied to port 375 exits via forward outlet port 376. The flow from port 376 is supplied to supply port 377 of an alternating level control valve 379. The valve 379 is capable of selectively defining either a wall surface cleaning mode or a water surface cleaning mode. Valve mode is switched whenever a flow to control port 378 is initiated. As shown in FIG. 20, the flow to control port 378 is derived from supply inlet 310. Accordingly, whenever the pump 10 starts up, the mode of valve 379 is changed.

Although FIG. 20 depicts the initiation of a flow to control port 378 from inlet 310 as the triggering event to switch the control valve 379 mode, other events could, of course, be used to toggle valve 379. Moreover, it should be recalled from FIG. 2 that it is appropriate to incorporate an input control for enabling a user to set or override the normal control of valve 379.

Note in FIG. 20 that water is supplied to the thrust/surface cleaning jets 314 during the normal state of the steering valves 375 regardless of the mode defined by alternating valve 379. Thus, when the system is in the wall surface cleaning mode, the body is forwardly propelled by the thrust/surface cleaning jets 314 and a component of the vacuuming jet pump 324. During the wall surface cleaning mode the body will be oriented nose down as shown in FIG. 16. The bottom of the collection bag 352 is located above the shelf surface 338 (FIG. 16) and, therefore, most of the water discharged from the thrust/surface cleaning jets 314 clings to the surface 338 and is discharged without passing through the collection bag. This results in greater propulsion and hold down thrust from these jets 314 than if the water were to pass through the bag material and debris therein. As the body 302 traverses the wall surface, debris is collected in the bag as a consequence of the action of vacuum jet pump nozzle 324. Further wall surface cleaning occurs as a consequence of the sweeping action of whip hose 382.

When the valve 379 defines the water surface cleaning, the lift jet 318 thrusts the body to the water surface to an equilibrium level at which the weight of the body, including the water filled cavities 362, above the water surface equals the vertical force component of lift jet 318. When at the water surface, the body assumes a more horizontal attitude so that as it moves forward along the water surface, water and floating debris will flow into the bag 352 above surface 338.

In typical automatic operation of the embodiment 300, the body 302 moves forward for two to five minutes cleaning either the wall surface or the water surface with its direction randomly influenced by objects it encounters and by water periodically jetted out of the left jet for about 30 seconds and subsequently out of the right jet for about 30 seconds. Intervals of straight travel occur before, between, and after the side thrust intervals. For example, each two to five minutes the body 302 can be caused to move rearwardly for about 30 seconds by discharging a flow through the backup thrust jet 316, which can optionally occur in conjunction with one of the side thrusts jets 326, 328. For example, the timing assembly steering valve can be programmed to provide three periods of alternating side thrusts during each major cycle with the side thrust during sequential backup intervals alternating.

Figure 17:
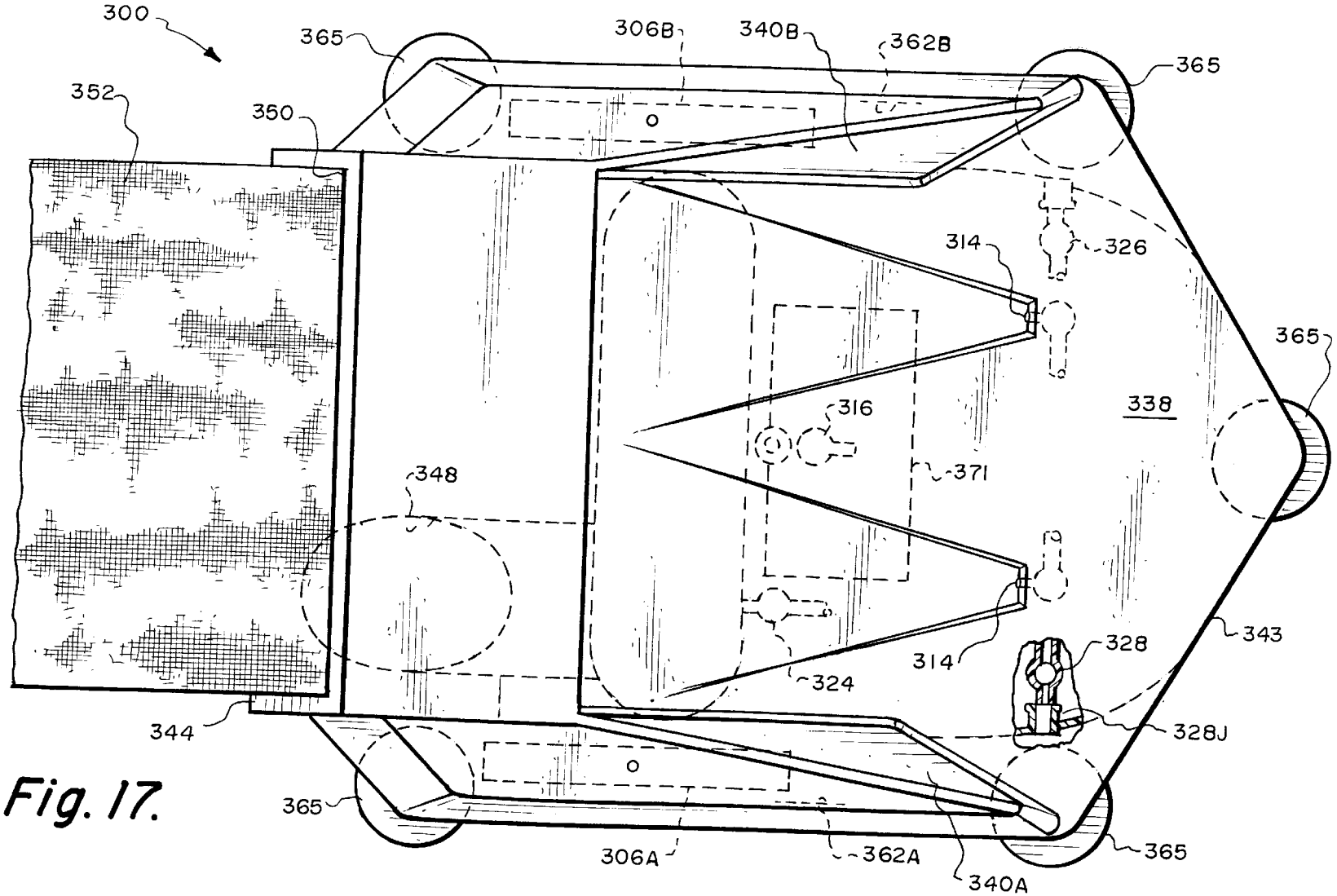
Figure 18:
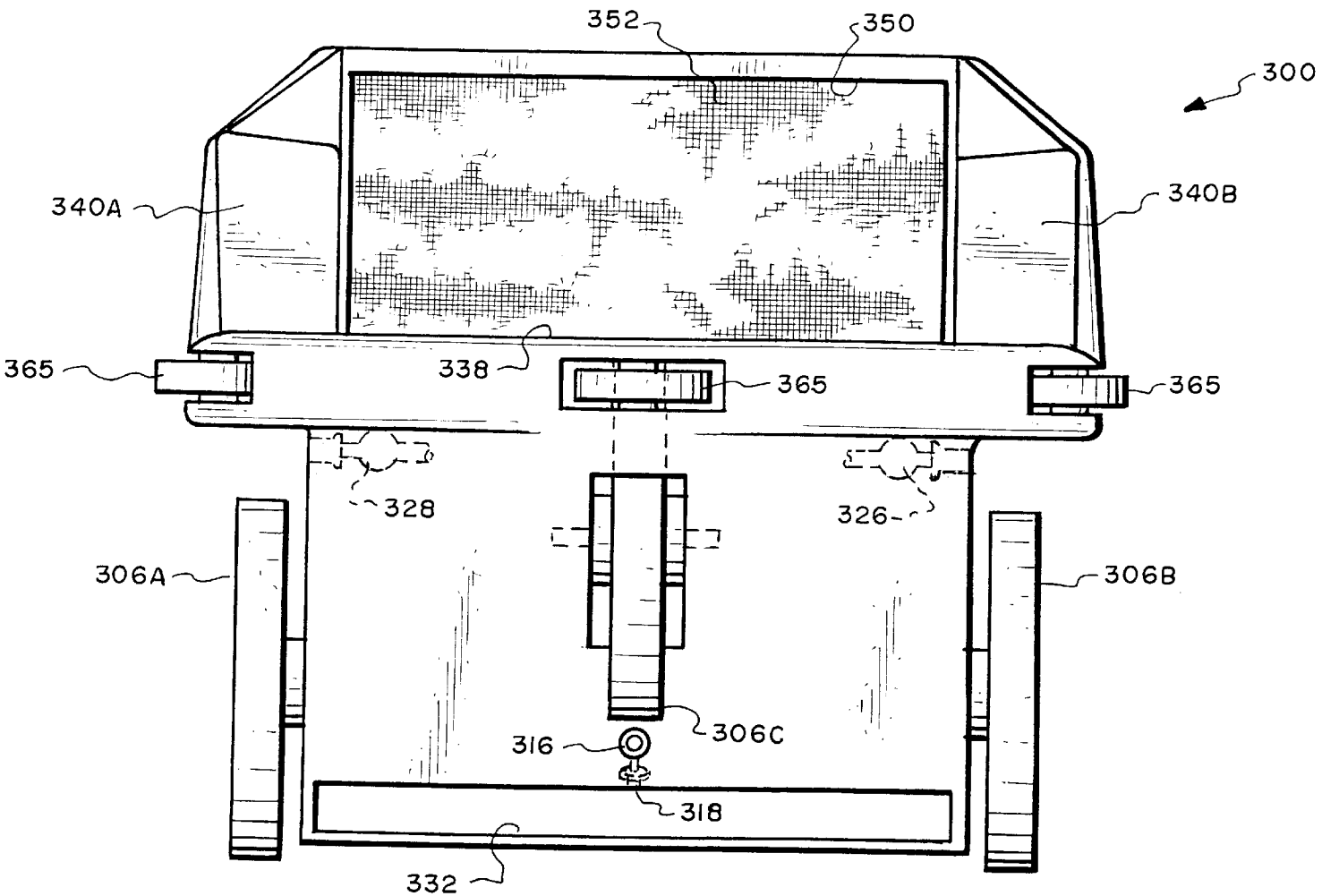
Figure 19:
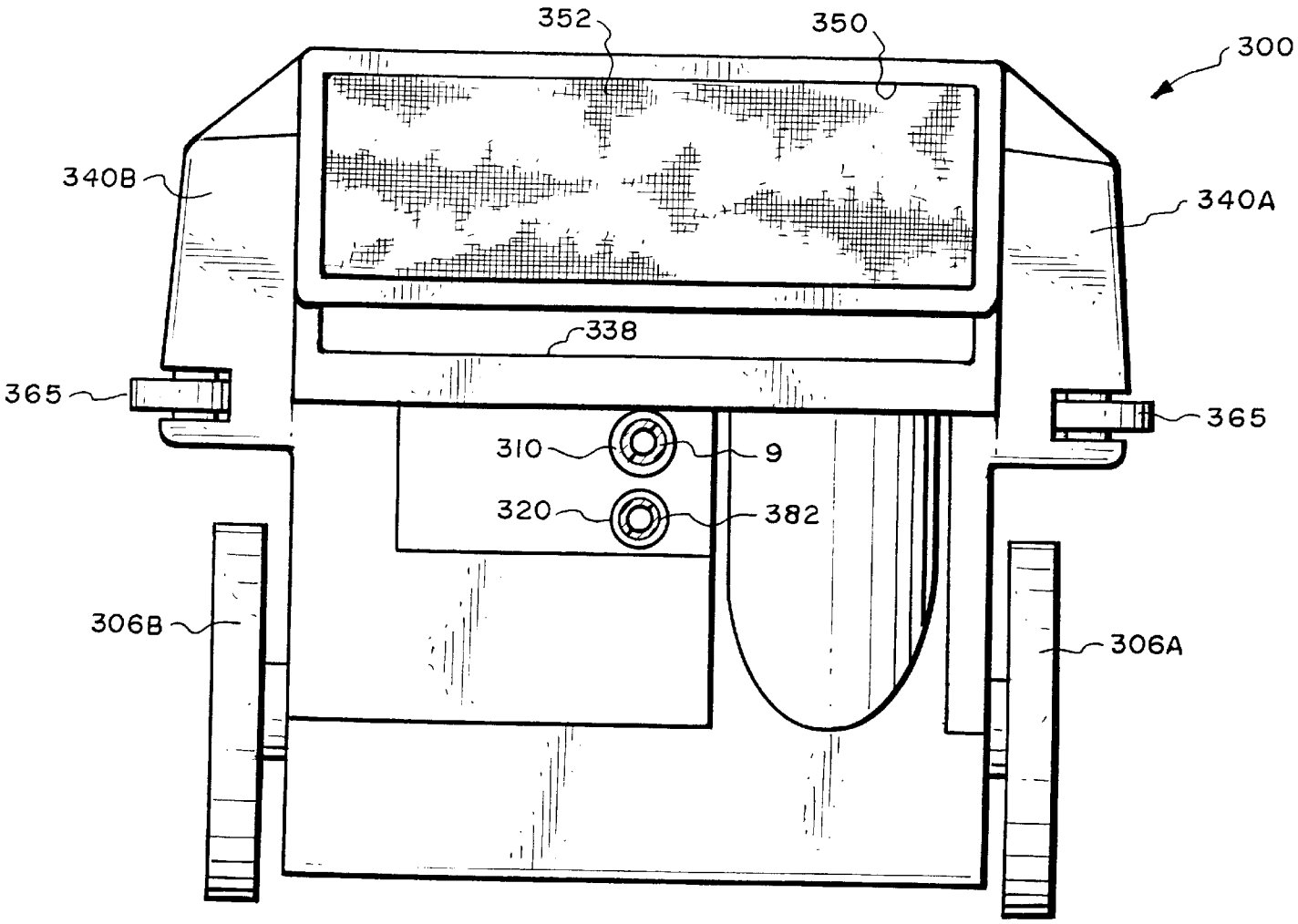

As depicted in FIG. 16, the lift jet 318 can optionally be configured as a jet pump 318J to increase water flow, thrust and efficiency. Similarly, a jet pump could also be substituted for any of the other aforementioned jets, such as right jet pump 328J (FIG. 17).

Fourth Embodiment (FIGS. 21–27)

Figure 23:
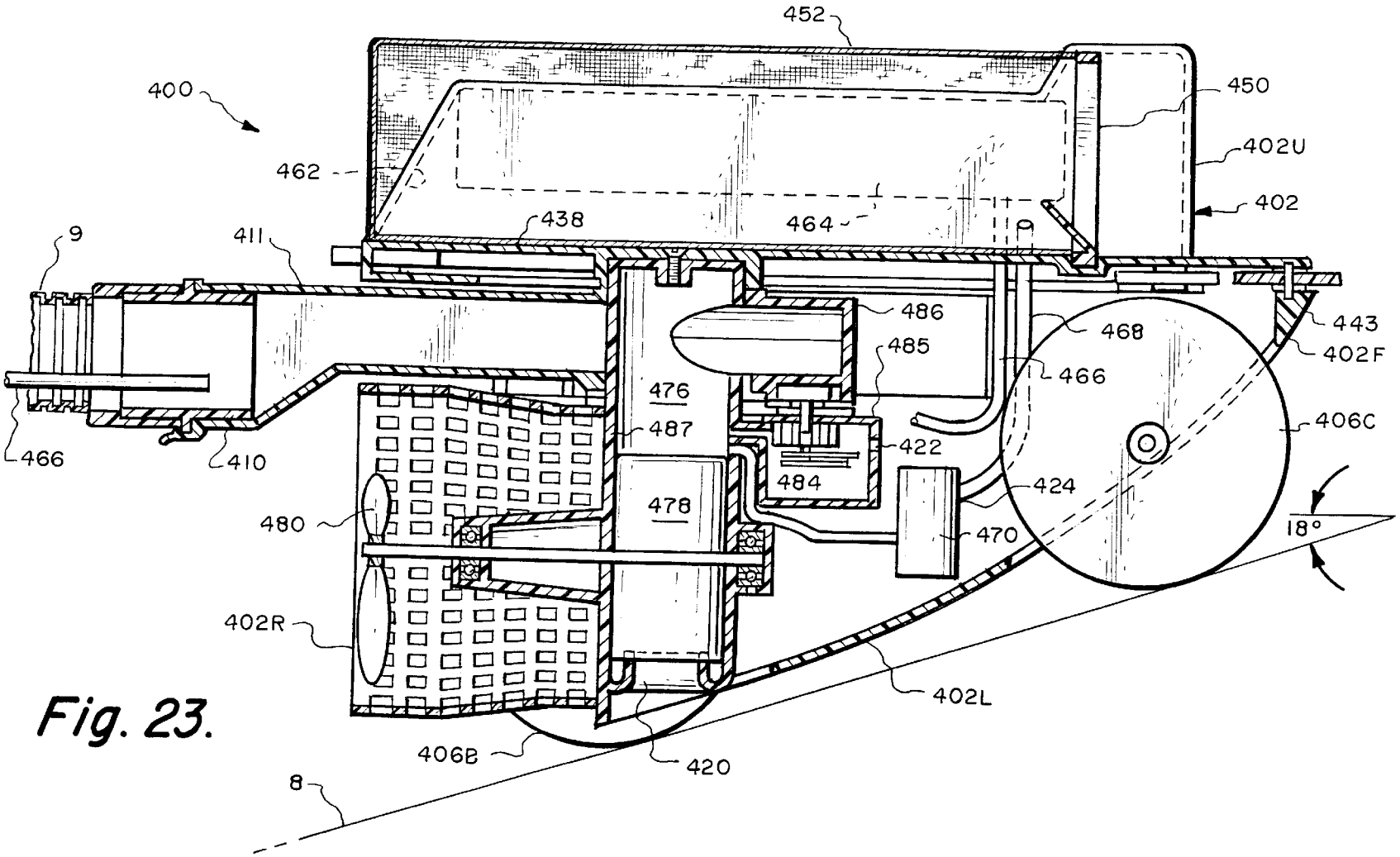
Figure 24:
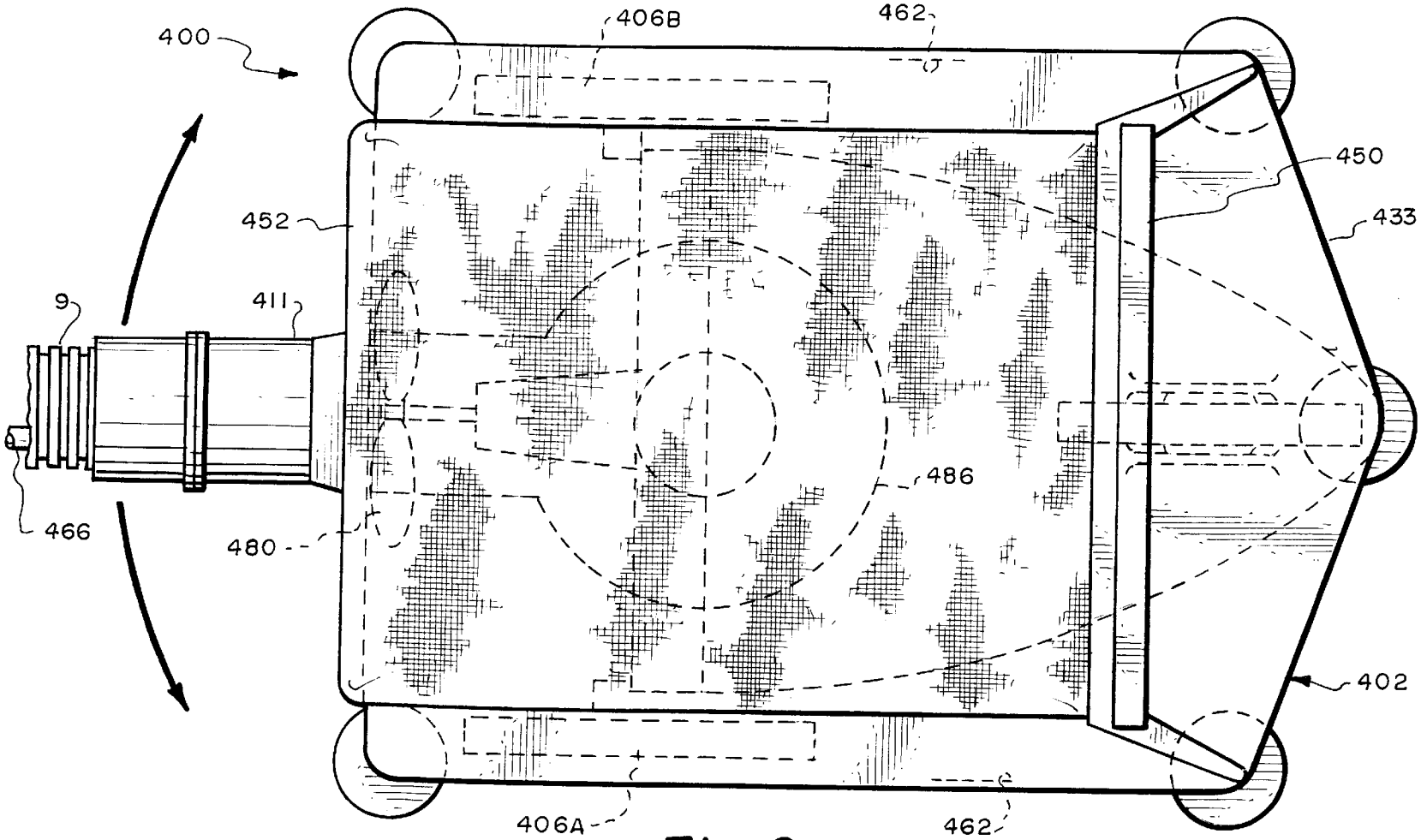
Figure 25:
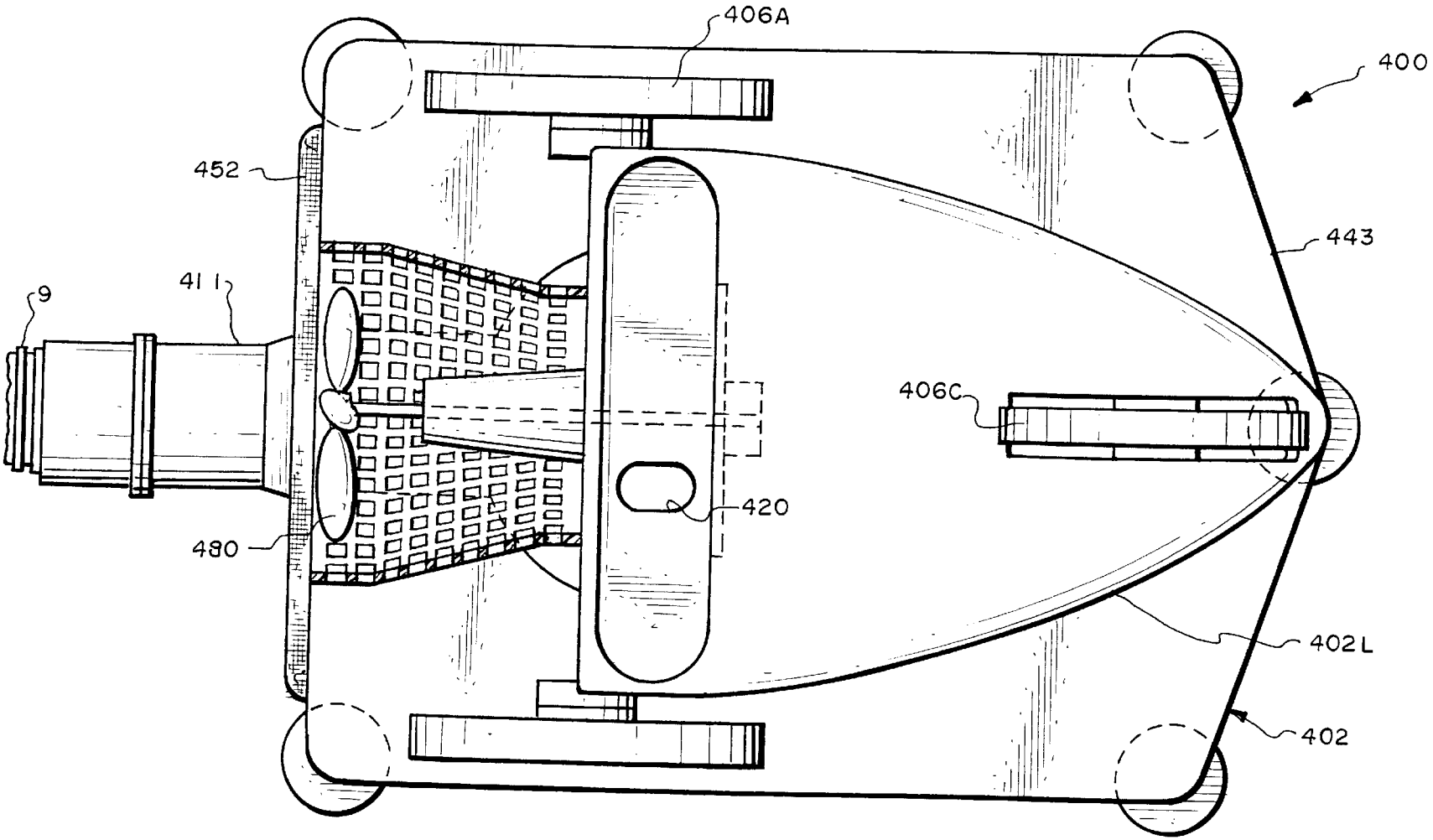
Figure 26:
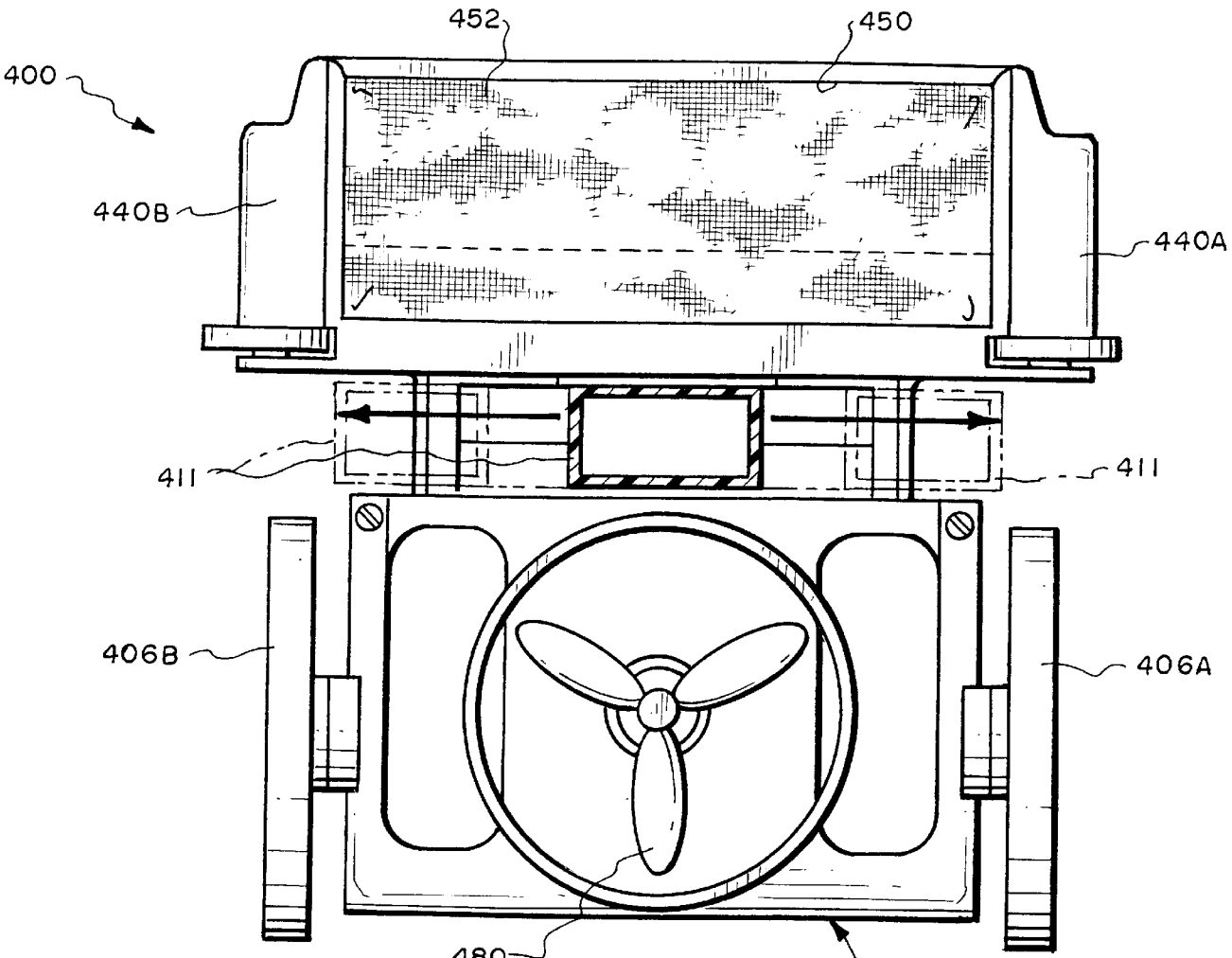

Attention is now directed to FIGS. 21–27 which depict a fourth embodiment 400 of the invention designed to be powered from the negative pressure (suction) side of a motor driven hydraulic pump 10, via a hose 9 (FIGS. 1A, 1B), which is preferably specially configured as is depicted in FIG. 23. The embodiment 400 is comprised of a unitary body 402 which is primarily formed of upper and lower molded sections 402U and 402L. Lower body section 402L supports three traction wheels 406A, 406B, 406C mounted for free rotation on horizontal axles for tangentially engaging interior wall surface 8. As shown in FIG. 23, the traction wheels are arranged on the body so that when resting on a horizontal surface, the nose or front 402F of the body will be inclined downwardly from the rear 402R of the body by about 18 degrees. The body 402 is provided with an outlet supply fitting 410 which is mounted in the free end of swivel arm 411 and coupled to the distal end of supply hose 9. The proximal end of hose 9 is coupled to the suction side of pump 10. The pump suction applied to fitting 410 is coupled via arm 411 to various inlets in the body 402 including:

| | |
|---|---|
| 1. vacuuming inlet | 420 |
| 2. timing assembly timing inlet | 422 |
| 3. alternating valve inlet | 424 |

As will be seen hereinafter, pump suction is able to pull water in through these inlets for flow through outlet fitting 410 to the pump 10 suction side.

The upper body section 402U is comprised primarily of a horizontally oriented surface 438 having a pair of upstanding side walls 440A and 440B. The surface 438 defines a leading edge 443 and a trailing edge 444. The open mouth 450 of a water surface debris collection container or bag 452 is detachably mounted to the body 402 behind the leading edge 443 above the surface 438. The bag 452 is preferably formed of water permeable material to permit water flow therethrough.

Figure 27:
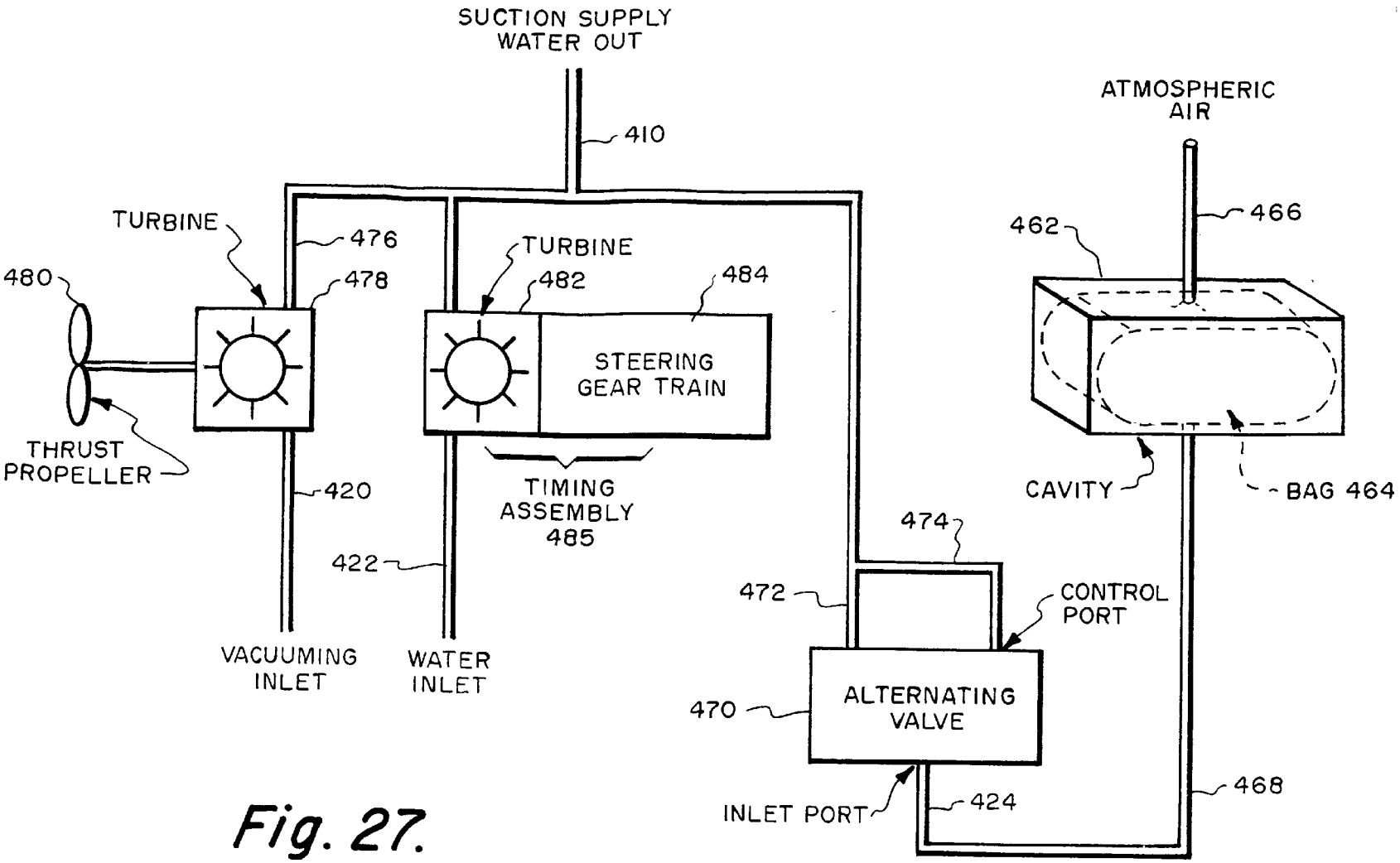
FIG. 27 is a flow diagram describing the operation of the embodiment of FIGS. 21–26.

The aforementioned upstanding walls 440A and 440B, each enclose a cavity 462 containing flaccid plastic bag 464. An air tube 466 communicates with the flaccid bag 464 and extends through hose 9 as depicted in FIG. 23 to atmospheric air above the water surface, e.g., in the pools built-in wall skimmer (not shown). The water cavity 462 communicates with a tube 468 which is connected to the inlet port 424 of an alternating valve 470. As is shown in FIG. 27, the outlet side of the alternating valve 470 is connected via a port 472 to the suction outlet fitting 410. Additionally, the alternating valve control port is similarly connected to suction fitting 410.

The aforementioned vacuum inlet 420 shown in FIG. 23 opens into a vacuuming path 476 which includes a turbine 478. The vacuuming path 476 discharges into the suction outlet fitting 410 via swivel arm 411. Thus, when water is pulled in through the vacuuming inlet 420 by the pump suction applied to fitting 410, it will move past and drive turbine 478. A thrust propeller 480 is mounted to the shaft of turbine 478 for propelling the body along either the wall surface or on the water surface.

The water inlet 422 drives a turbine 482 which is coupled to a steering gear train 484 of a timing assembly 485. This gear train is coupled to the hub 486 of swivel arm 411 for rotating the hub arm around post 487.

The alternating valve 470 is capable of toggling between a water surface cleaning mode and a wall surface cleaning mode. Switching of the alternating valve mode is in response to the initiation of flow through the control port 474. Port 474 is coupled via fitting 410 to pump suction via hose 9 and thus in the configuration shown, the valve 470 mode changes whenever the pump starts up.

For water surface cleaning, the alternating valve 470 directs the suction available at fitting 410 to draw water out of the cavities 462. This permits the plastic bag 464 within each cavity to pull air in via tube 466 which, as has been noted, is routed through supply hose 9 to atmospheric air. As the bags 464 fill with air, the buoyancy of the body increases and causes the body to float to the water surface with great stability. As the propeller 480 propels the body forward, water and floating debris are scooped from the water surface above shelf surface 438 and guided into the permeable collection bag 452 via the open mouth 450.

When the mode of alternating valve 470 changes to the wall surface cleaning mode, it will stop drawing water out of the cavities 462 and allow water to flow into the cavities causing the internal bags 464 to collapse and pushing the air therein out through the tube 466. This action causes the body to lose buoyancy and sink to the pool bottom for operation in the wall surface cleaning mode. In the wall surface cleaning mode, the body will be propelled along the wall surface by the action of propeller 480 driven by turbine 478. The turbine 478 is driven by the flow of water drawn into vacuuming inlet 420 as a consequence of the suction applied to path 476 via fitting 410. Debris drawn into the vacuuming inlet 420 during the wall surface cleaning mode will be carried through to the pool filter or can be collected by an inline collection container located somewhere along the length of supply hose 9 or in the conventional built in wall skimmer.

In normal automatic operation, the body 402 is propelled forwardly by propeller 48 in both the wall surface cleaning mode and the water surface cleaning mode. The direction of movement of the body will be randomly influenced by that which it encounters and by the rotation of the body relative to the swivel arm 411. The arm 411 is reciprocally rotationally driven around post 487 by the action of the steering gear train 484. Preferably, the arm 411 can rotate approximately 270 degrees in one direction over a one to four minute interval. The arm then is driven in the opposite direction for a similar period. The two states of directional rotation, i.e., clockwise and counter-clockwise, are controlled by the timing assembly 485.

The following Table II lists the primary characteristics of a typical unit corresponding to embodiment 400:

Types of pools Cleaned: All Inground and Aboveground Pools
Power source: Pool Pump
Wheels—number / diameter: 3 wheels / 4" diameter
Wall cleaning: Vacuum
Vacuum minimum diameter: 1⅜"
Vacuum opening width: 7"
Debris collected in: Inline container
Propulsion: Turbine driven propeller
Wall surface travel path: 270 degrees clockwise & 270 degrees counterclockwise with pauses as desired
Water surface cleaning: Skims
Debris collected in: Mesh bag
Debris collection bag opening: 3" high×8" wide
Propulsion: Turbine driving a propeller
Lift: Air from above water in skimmer box
Wall surface travel path: Same as on pool bottom From the foregoing, it should now be appreciated that a method and apparatus has been disclosed for automatically cleaning a water pool characterized by the use of a unitary body structure which travels between the wall surface and water surface. The body structure is preferably compactly dimensioned, i.e., within a 2'×2'×2' envelope, and has hydrodynamically shaped exterior surfaces, which can in part be defined by fins or wings, enabling it to move efficiently through the water. More particularly, the body's exterior contour is preferably shaped to facilitate its travel underwater adjacent to the wall surface, its travel from the wall surface to the water surface, its travel from the wall surface to the water surface, and its travel along the water surface. For this purpose, the body exterior can be contoured so that (1) its travel along the wall surface produces a hold down force component urging its traction means more tightly against the wall surface, (2) its travel proximate to the water surface produces a lift force component to help maintain the body at the water surface and (3) its travel between the wall surface and water surface generates forces appropriate to maintaining the correct attitude of the body and efficiently employing the source energy.

Although the present invention has been described in detail with reference only to a few specific embodiments, those of ordinary skill in the art will readily appreciate that various modifications can be made without departing from the spirit and the scope of the invention.

We claim:

1. Apparatus for use with a containment wall having bottom and side portions containing a pool of water, for cleaning the surface of said water and the surface of said wall, said apparatus comprising:

a unitary body capable of being immersed in said pool water;

means for supplying a fluid flow to said body;

a level control subsystem responsive to said fluid flow for producing a vertical force to selectively place said body either (1) proximate to said water surface or (2) proximate to said wall surface below said water surface;

at least one pool water inlet in said body; and a propulsion control subsystem responsive to said fluid flow for selectively moving said body either (1) along a path adjacent to said water surface for collecting pool water through said inlet from adjacent to said water surface or (2) along a path adjacent to said wall surface for collecting pool water through said inlet from adjacent to said wall surface.

2. The apparatus of claim 1 wherein said body is heavier than water; and wherein said level control subsystem defines an active state for producing a vertical force component for lifting said body to proximate to said water surface.

3. The apparatus of claim 1 wherein said body is lighter than water; and wherein said level control subsystem defines an active state for producing a vertical force component for holding said body proximate to said wall surface.

4. The apparatus of claim 1 further including:

means for removing debris from pool water collected through said inlet.

5. The apparatus of claim 4 wherein said means for removing debris includes a water permeable debris container for retaining debris removed from water received through said inlet.

6. Apparatus for cleaning both the interior wall surface of an open container and the water surface of a water pool contained therein, said apparatus comprising:

a unitary body immersible in said water pool;

a level control element for defining either a wall surface cleaning mode or a water surface cleaning mode;

automatic control means for selectively switching the mode defined by said level control element means for maintaining said body adjacent to said interior wall surface when said level control element is in said wall surface cleaning mode;

means for supporting said body proximate to said water surface when said level control element is in said water surface cleaning mode;

at least one pool water inlet in said body; and means for collecting pool water through said inlet from (1) adjacent to said interior wall surface when said level control element is in said wall surface cleaning mode and (2) adjacent to said water surface when said level control element is in said water surface cleaning mode.

7. The apparatus of claim 6 wherein said body is comprised of upper and lower portions spaced in a nominally vertical direction and front and rear portions spaced in a nominally horizontal direction; and wherein said means for maintaining said body adjacent said interior wall surface comprises means for producing a force component in said nominally vertical direction toward said interior wall surface.

8. The apparatus of claim 7 wherein said means for producing a force component in said nominally vertical direction includes means for creating a water outflow from said body having a component oriented in a direction from said body lower portion toward said body upper portion.

9. The apparatus of claim 6 further including a mode control device for selectively switching said level control element.

10. The apparatus of claim 9 further including an event sensor; and wherein said mode control device is responsive to said event sensor for switching said level control element from one of said modes to the other of said modes.

11. The apparatus of claim 10 further including an override mechanism for preventing said level control element from switching modes.

12. The apparatus of claim 9 further including a pump actuatable to supply a fluid flow to said body; and wherein said mode control device is responsive to the actuation of said pump for switching said level control element from one of said modes to the other of said modes.

13. The apparatus of claim 12 further including an override mechanism for preventing said level control element from switching modes.

14. The apparatus of claim 6 further including a propulsion subsystem for propelling said body relative to said wall surface.

15. The apparatus of claim 6 further including a propulsion subsystem for propelling said body relative to said water surface.

16. Apparatus for cleaning the surface of a water pool contained in a vessel defined by a wall having bottom and side portions, said apparatus comprising:

a unitary heavier-than-water body capable of being immersed in said water pool;

a level control subsystem carried by said body;

means for supplying a fluid flow to said body to lift said body to proximate to said water surface;

a water surface inlet carried by said body configured to collect pool water from adjacent to said water surface; and a propulsion control subsystem for moving said body along a path adjacent to said water surface.

17. The apparatus of claim 16 further including means for removing debris from water received via said water surface inlet.

18. The apparatus of claim 17 wherein said means for removing debris includes a water permeable debris container for retaining debris removed from water received via said water surface inlet.

19. A method of cleaning both the interior wall surface of an open container and the water surface of a water pool contained therein, said method comprising:

placing a body in said water pool;

supplying a fluid flow to said body for producing a vertical force thereon to selectively move said body to either (1) proximate to said water surface or (2) proximate to said wall surface below said water surface;

urging said body against said interior wall surface when said body is proximate to said wall surface;

supporting said body proximate to said water surface when said body is proximate to said water surface; and collecting pool water from (1) adjacent to said water surface when said body is proximate to said water surface and (2) adjacent to said wall surface when said body is proximate to said wall surface.

20. The method of claim 19 further including:

propelling said body along a path adjacent to said wall surface for cleaning said wall surface.

21. The method of claim 19 further including: propelling said body along a path adjacent to said water surface for cleaning said water surface.

22. The method of claim 19 further including removing debris from said collected pool water.

* * * * *